US006247666B1

(12) United States Patent
Baker et al.

(10) Patent No.: US 6,247,666 B1
(45) Date of Patent: Jun. 19, 2001

(54) METHOD AND APPARATUS FOR NON-PROPULSIVE FIN CONTROL IN AN AIR OR SEA VEHICLE USING PLANAR ACTUATION

(75) Inventors: Brian C. Baker; Johnny Edward Banks, both of Arlington, TX (US)

(73) Assignee: Lockheed Martin Corporation, Grand Prairie, TX (US)

( * ) Notice: Subject to any disclaimer, the term of this patent is extended or adjusted under 35 U.S.C. 154(b) by 0 days.

(21) Appl. No.: 09/110,504

(22) Filed: Jul. 6, 1998

(51) Int. Cl.[7] ..... F42B 10/02

(52) U.S. Cl. ..... 244/3.21; 244/3.15; 244/3.24; 244/3.27; 244/3.29

(58) Field of Search ..... 244/3.15, 3.19, 244/3.2, 3.21–3.29, 3.3

(56) References Cited

U.S. PATENT DOCUMENTS

| | | | | |
|---|---|---|---|---|
| 2,868,478 | | 1/1959 | McCloughy . | |
| 2,873,074 | * | 2/1959 | Harris, Jr. et al. | 244/3.21 |
| 3,355,130 | | 11/1967 | Dell | 244/3.21 |
| 3,415,467 | * | 12/1968 | Barringer | 244/3.29 |
| 4,210,298 | | 7/1980 | Liberman | 244/3.21 |
| 4,325,586 | | 4/1982 | Hubert et al. . | |
| 4,579,298 | | 4/1986 | Thomson | 244/3.21 |
| 5,048,772 | | 9/1991 | Wisshaupt | 244/3.23 |

FOREIGN PATENT DOCUMENTS

| | | |
|---|---|---|
| 8514910 U | 11/1986 | (DE) . |
| 3717688 | 6/1988 | (DE) . |
| 2086321 | 5/1982 | (GB) . |

OTHER PUBLICATIONS

Wassom et al., "Integrated Aerofin/Thrust Vector Control for Tactical Missiles," *AIAA 25th Joint Propulsion Conference*, Monterey, California (Jul. 10–12, 1989).

"Elements," Book I, by Euclid, in Engish translation on the Internet at aleph0.clarku.edu/~ djoyce/java/elements/book1/book1.html.*

* cited by examiner

*Primary Examiner*—Bernarr E. Gregory
(74) *Attorney, Agent, or Firm*—Williams, Morgan & Amerson, P.C.

(57) ABSTRACT

The invention, in one embodiment, is an apparatus for controlling the roll, pitch, and yaw attitudes of an air or sea vehicle. The apparatus includes an actuator including an actuation plane and an actuation mechanism, capable of displacing the actuation plane at three points; at least three non-propulsive fins; and a linkage between the actuator and each one of the fins, the linkage communicating the actuation plane's displacement to the respective one of the fins.

44 Claims, 27 Drawing Sheets

METHOD AND APPARATUS FOR NON-PROPULSIVE FIN CONTROL IN AN AIR OR SEA VEHICLE USING PLANAR ACTUATION

BACKGROUND OF THE INVENTION

1. Field of the Invention

This invention relates generally to non-propulsive fin control in an air or sea vehicle and, more particularly, to such a method and apparatus using planar actuation.

2. Description of the Related Art

An air or sea vehicle's control system provides a mechanism to control the vehicle's direction of travel. The directional control may be accomplished by directing the vehicle to travel with a particular vehicle attitude with respect to the relative movement through a fluid in which the vehicle is traveling. Typically the control system, whereby the non-propulsive fins are independently commanded, provides the attitude control required to traverse a given path.

A vehicle's attitude can be divided into roll, pitch, and yaw attitudes. The control of the vehicle's attitude can be theoretically realized through the use of three fins to control the vehicle's roll, pitch, and yaw attitudes. Typically, however, four fins are implemented, and occasionally five or more are used.

The number of fins implemented depends on the vehicle's application. Increasing the number of fins will in turn increase the amount of control force the fins will provide. However, increasing the fin control force does not necessarily increase the maneuverability of the vehicle. Increasing the number of fins in a traditional manner will also increase the weight and complexity of the vehicle, which may offset the increased control force produced.

The vehicle's roll, pitch, and yaw attitudes can be controlled by rotating the fins in a predetermined fashion to obtain a desired vehicle attitude, regardless of the number of fins. Typical implementations use a separate actuator for each fin so that each fin may be commanded independently. The use of separate actuators for each fin has some undesirable effects. For instance, separate actuators increase vehicle weight, complexity and the possibility of relative fin rotation error. Minimizing vehicle weight is a high priority in vehicle design because vehicle mass directly contributes to maneuverability potential. Slight increases in mass can make significant changes in vehicle agility and/or range performance. Decreasing vehicle complexity is important from a standpoint of vehicle reliability and cost. Reduced complexity designs are in general less costly to produce and operate more reliably than higher complexity designs. Control system relative rotation error is induced when individual actuators per fin are employed because of positional errors associated with each actuator. The positional errors can corrupt the desired relative rotation angles between fins and induce error into the commanded roll, pitch, and yaw attitudes.

The present invention is directed to overcoming one, or more, of the problems set forth above.

SUMMARY OF THE INVENTION

The invention, in one embodiment, is an apparatus for controlling the roll, pitch, and yaw attitudes of an air or sea vehicle. The apparatus comprises an actuator including an actuation plane and an actuation mechanism, capable of displacing the actuation plane at three points; at least three non-propulsive fins; and a linkage between the actuator and each one of the fins, the linkage communicating the actuation plane's displacement to the respective one of the fins.

BRIEF DESCRIPTION OF THE DRAWINGS

Other objects and advantages of the invention will become apparent upon reading the following detailed description and upon reference to the drawings in which:

FIG. 1 is an isometric view; FIG. 2 is a cross-sectional, plan view along line 2—2 of FIG. 1; and FIG. 3 is a partial cross-sectional, right side view. The fins in each of FIGS. 1–3 are undeflected.

FIGS. 4A and 4B are isometric and plan views, respectively. FIG. 4C is a partial cross-sectional, right side view.

FIGS. 5A and 5B are isometric and plan views, respectively. FIG. 5C is a partial cross-sectional, right side view.

FIGS. 6A and 6B are a partial cross-sectional, isometric view and a plan view, respectively. FIG. 6C is a partial cross-sectional, bottom view.

FIGS. 7 and 8 are isometric and plan views, respectively. FIG. 9 is a partial cross-sectional, right side view. The fins in each of FIGS. 7–9 are undeflected.

FIGS. 10A and B are a partial cross-sectional, isometric view and a plan view, respectively. FIG. 10C is a partial cross-sectional, right side view.

FIGS. 11A and B are a partial cross-sectional, isometric view and a plan view, respectively. FIG. 11C is a partial cross-sectional, right side view.

FIG. 12A is a plan view and FIG. 12B is a partial cross-sectional view from below the fin control system.

Figure 1:
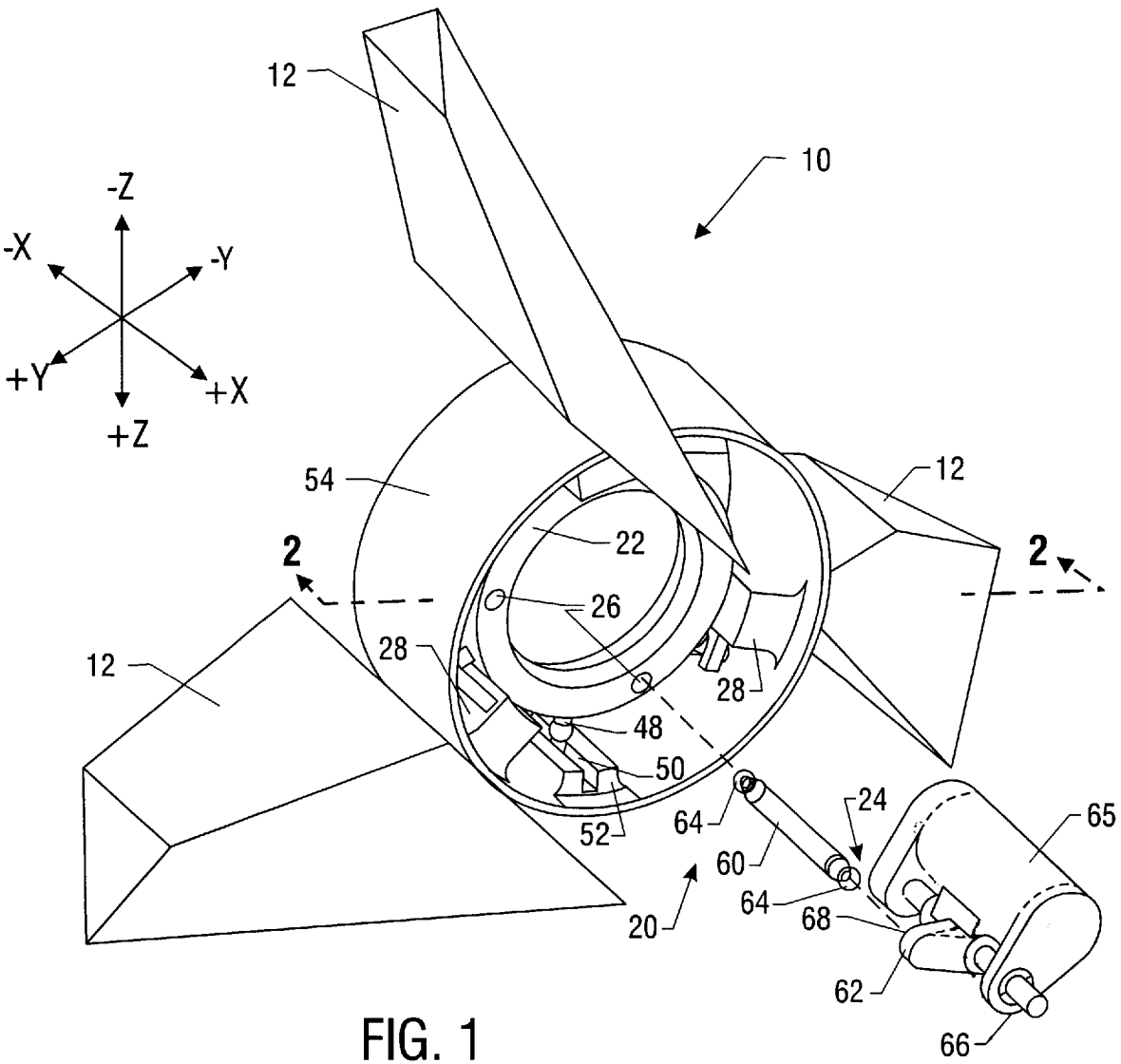
FIGS. 1–3 illustrate a first embodiment of a non-propulsive fin control system for an air or sea vehicle constructed and operated in accordance with the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and businessrelated constraints, which may vary from one implementation to another. Moreover, it will be appreciated that such a development effort, even if complex and time-consuming, would be a routine undertaking for those of ordinary skill in the art having the benefit of this disclosure.

Figure 2:
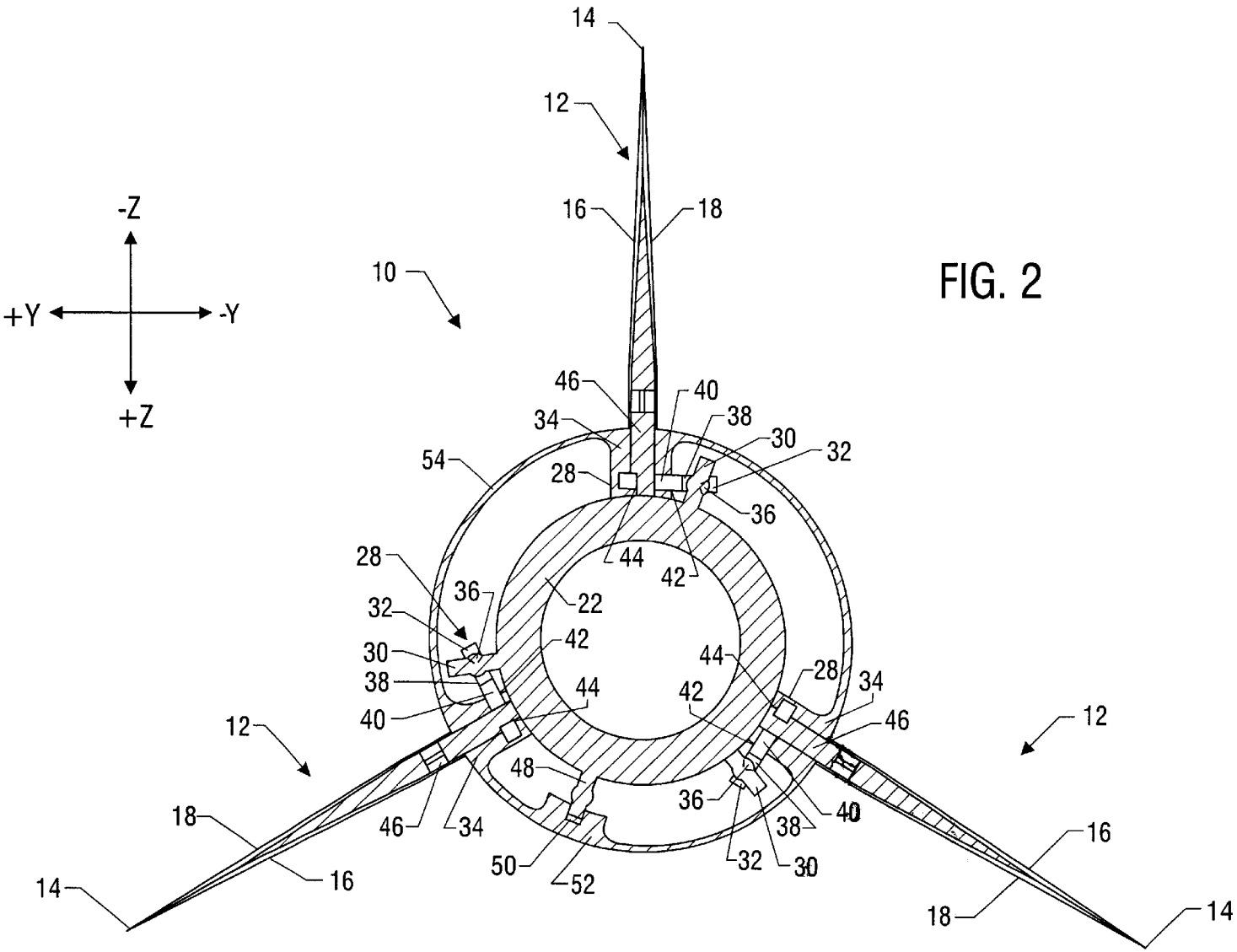
Figure 3:
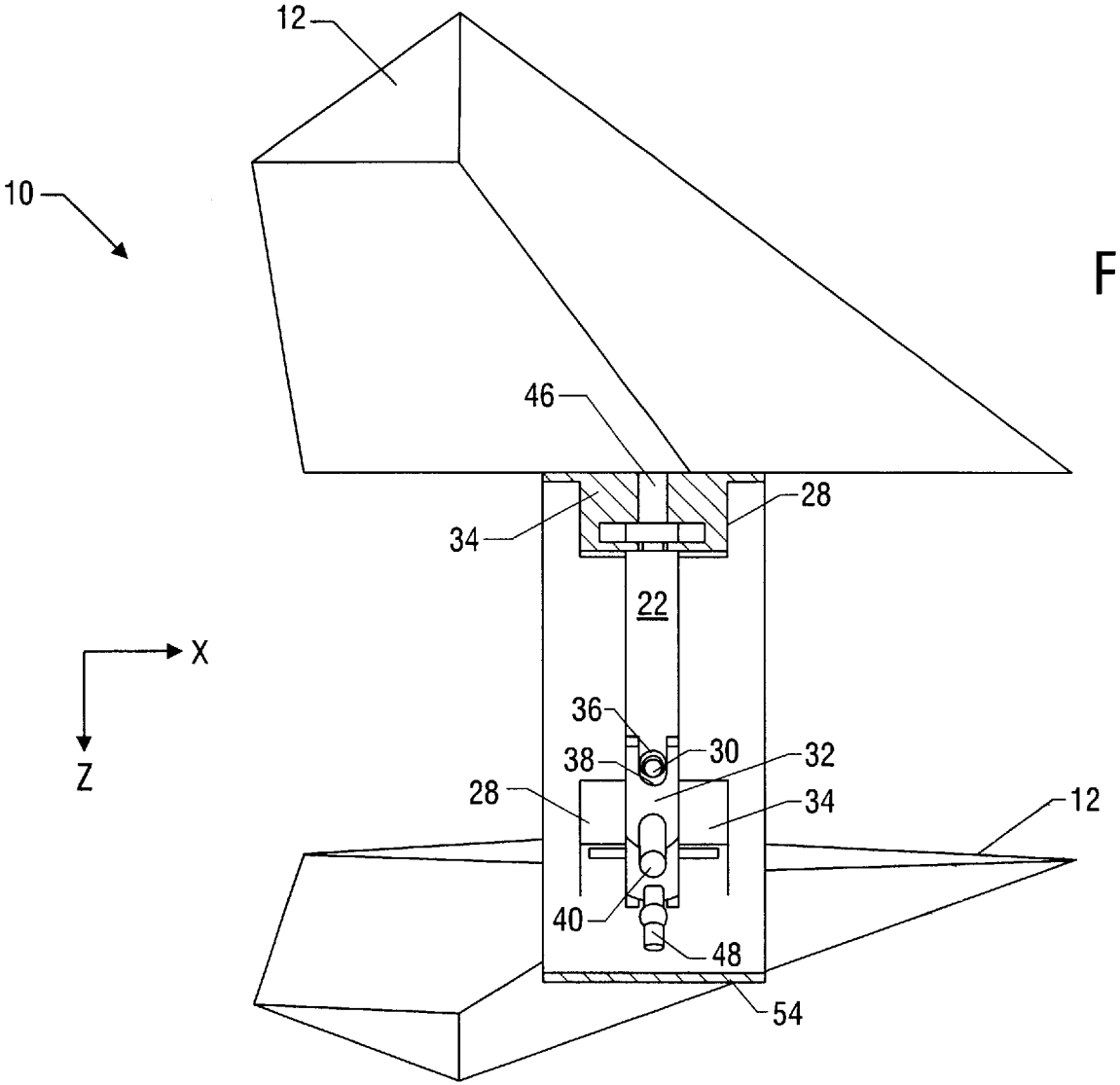

FIGS. 1–3 illustrate a particular embodiment 10 of an air or sea vehicle, non-propulsive fin control system constructed and operated in accordance with the invention. The control system 10 is for use with a missile. However, in alternative embodiments the control system 10 may be used with a guided bomb, a guided munition, and/or another air or sea vehicle employing non-propulsive fins. As shown best in FIG. 2, the control system 10 includes at least three non-propulsive fins 12, each of which provides a flight control surface 14 comprised of first and second faces 16 and 18, respectively. The number of flight control surfaces 14 is not material to the practice of the invention provided there are at least three. Thus, this particular embodiment may be used with any number of fins 12 greater than, or equal to, three. The flight control surfaces 14 control the pitch, yaw, and roll attitudes of the vehicle controlled by the control system 10.

Returning to FIG. 1, the control system 10 includes an actuator 20 that positions the fins 12. The actuator 20 comprises an actuation plane 22 and an actuation mechanism 24 capable of displacing the actuation plane at three points 26. More than three points 26 may be used in some alternative embodiments and the particular embodiment of FIGS. 1–3 may, in some implementations, displace the actuation plane 22 at as many as fifty points. As will be recognized by those skilled in the art having the benefit of this disclosure, the ability to use many motors as well as few motors adds flexibility to the motor selection process. The points 26 in the embodiment of FIGS. 1–3 are spaced equidistantly about the actuation plane 22, although this is not necessary to the practice of the invention.

The actuation plane 22 may be any suitable planar member and, in the particular embodiment 10, is a rigid, uniform, aluminum ring. However, it is not necessary to the practice of the invention that the actuation plane 22 be a ring as other geometries may be used. The actuation plane 22 may even, in some embodiments, be a solid planar member (not shown). In general, the actuation plane 22 of the particular embodiment 10 illustrated should not obstruct the blast tube (not shown) if the fins 12 are deployed at the rear end of the vehicle. As will be apparent to those in the art having the benefit of this disclosure, obstruction of the blast tube is not a consideration if the fins 12 are deployed as a canard, i.e., at the front end of the vehicle.

The actuation plane 22 of the actuator 20 is coupled to the fins 12 and, hence, the flight control surfaces 14, by a linkage 28. As shown best in FIGS. 2–3, each linkage 28 comprises a bearing pin 30 extending from the actuation plane 22 and a fork 32 extending from a hinge pin 46. The bearing pin 30 includes a semi-spherical bearing 36 that fits into the notch 38 of the fork 32. The stem 40 of the fork 32 extends through a bore 42 in the boss 34 and an opening 44 in the hinge pin 46 of the fin 12. A track pin 48 also extends from the actuation plane 22 into the track 50 of a guide 52, although, in some embodiment, one of the bearing pins 30 might be used to implement the track pin 48 of the pictured embodiment. The bosses 34 and the guide 52 are either affixed to the fuselage 54 of the vehicle or are formed integrally therewith. Each boss 34 includes a bearing face 56 against which the actuation plane 22 moves.

Referring particularly to FIG. 1, the actuation mechanism 24 is shown in an exploded, isometric view. In this particular embodiment, the actuation mechanism 24 employs a push rod 60 and a transit 62. An actuator body 65 houses a drive motor (not shown) that rotates a screw 66. The transit 62 includes a ball screw (not shown) such that the transit 62 reciprocates as the screw 66 rotates. The push rod 60 includes a ball 64 at each end thereof that forms a ball joint with the actuation plane 22 and the transit 62. The ball joint between the push rod 60 and the actuation plane 22 forms one point 26 at which the actuation plane 22 may be displaced. The transit 62 includes the cup 68 in which one of the balls 64 fits to form a ball joint (not shown) between the transit 62 and the push rod 60.

As the transit 62 reciprocates, the push rod 60 also reciprocates, thereby displacing the actuation plane 22. The displacement of the actuation plane 22 is then communicated via the linkage 28 as described above to rotate the fin 12. The embodiment 10 includes one actuation mechanism 24 comprising such a transit 62 and push rod 60 combination for each point 26, and may, in various embodiments, include as few as three or as many as may be desired. The actuation mechanism 24 may be controlled using any suitable technique known to the art and will be implementation specific. The actuation mechanism 24 may, in various embodiments, be electromagnetic, electromechanical, purely mechanical, hydraulic, or pneumatic. Each actuation mechanism 24 may be controlled responsive to commands issued by a person or a computer (not shown) and each may be controlled independently of the others.

The actuation plane 22 is displaced, in the embodiment illustrated, by the actuation mechanism 24 at the points 26. "Displacement," in this context, means to move by translation along the x axis and/or rotation about the y and/or z axes, where the x, y and z axes are defined as in the figures. Note that the definition of the x-z axes will vary depending on the particular embodiment being implemented although the principle of operation will remain the same. Such variations will be readily apparent to those skilled in the art and having the benefit of this disclosure. Thus, such artisans will be able to readily extrapolate the above discussion regarding the displacement of the actuation plane 22 to adjust the roll, pitch, and yaw attitudes of alternative embodiments.

Depending on the control to be exerted over the vehicle's attitude, the actuation plane 22 may be displaced at any number of the points 26. For instance, the roll attitude of the vehicle may be controlled by displacing the actuation plane 22 along the x-axis defined in FIG. 1 at each of the points 26 simultaneously. Unequal displacement of the actuation plane 22 along the defined x-axis at the points 26 will cause various rotations of the actuation plane 22 that will, in turn, affect the yaw and pitch attitudes of the vehicle as discussed more filly below. The degree of displacement may differ at various points 26 to alter combinations of the yaw, pitch, and roll attitudes of the vehicle.

Figure 4A:
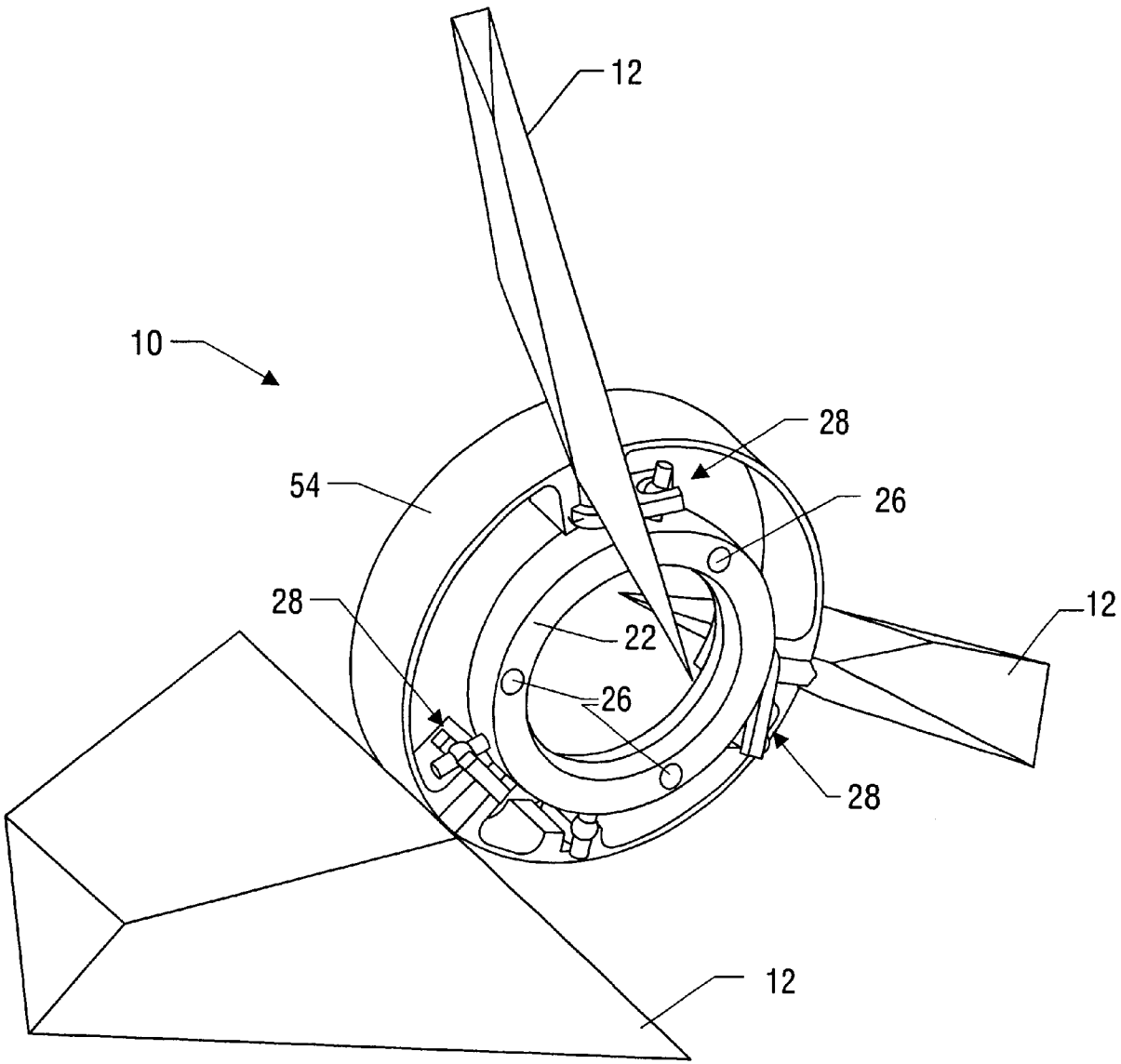
FIGS. 4A–C show the fins of the fin control system in FIGS. 1–3 in a positive roll deflection.
Figure 4B:
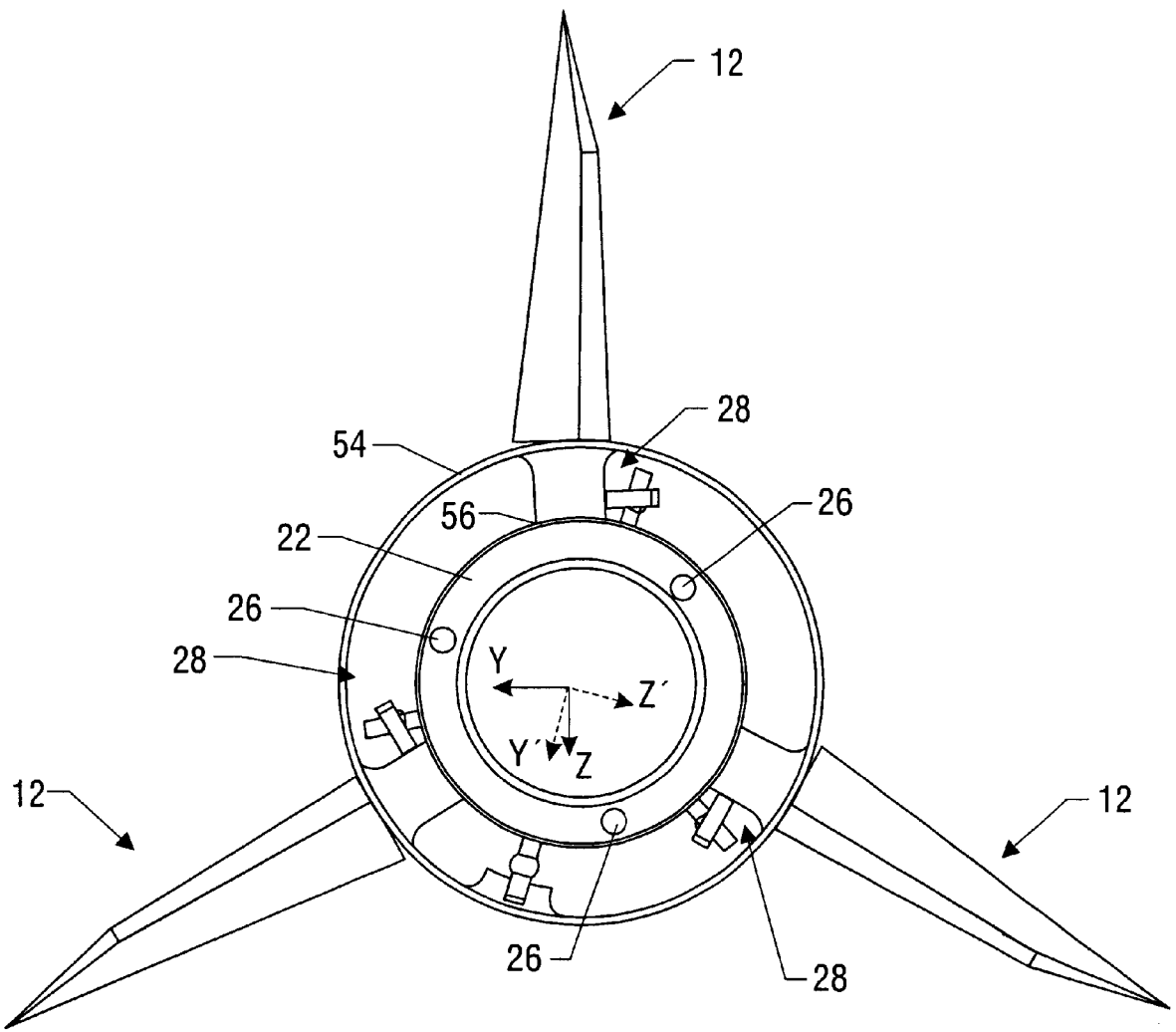
Figure 4C:
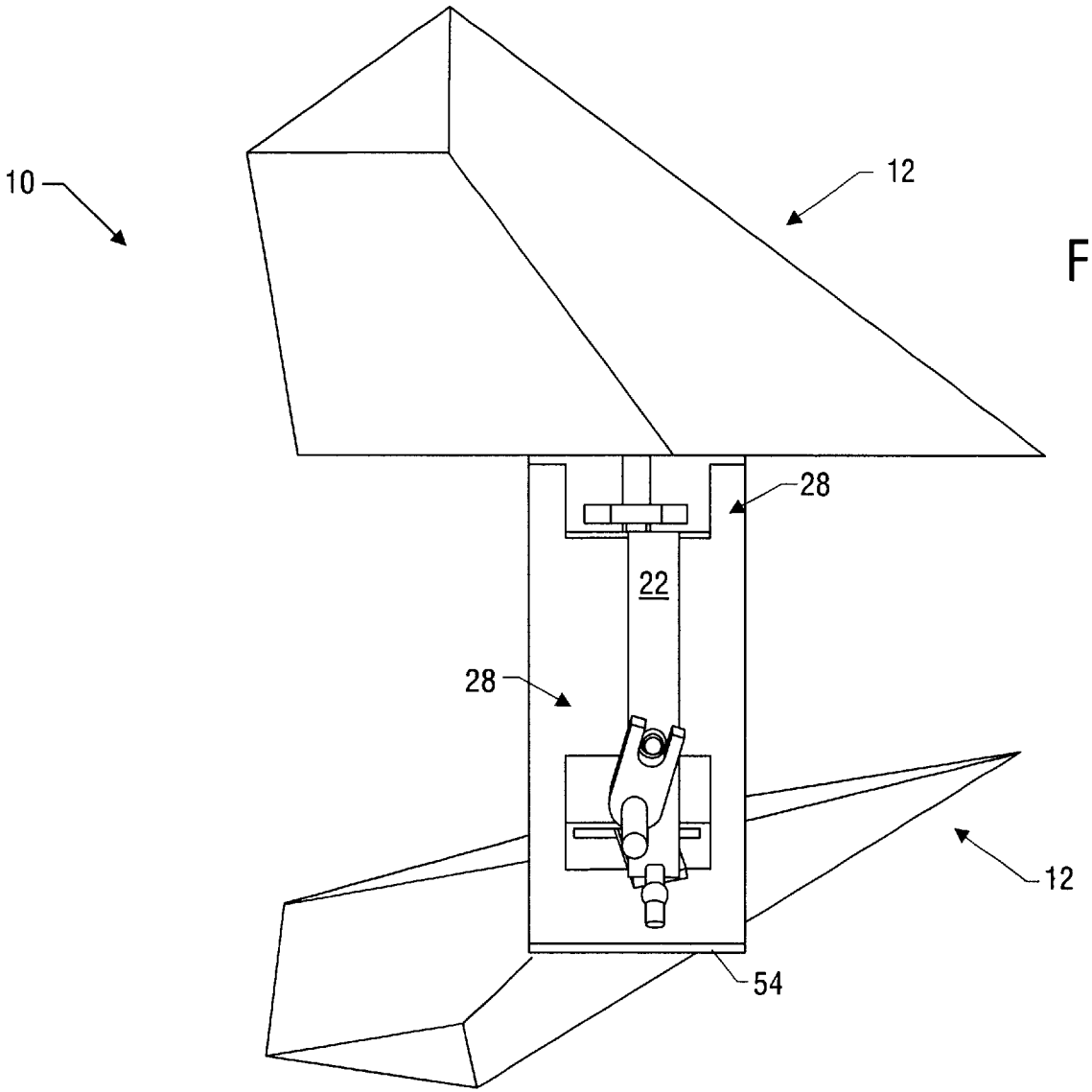
Figure 5A:
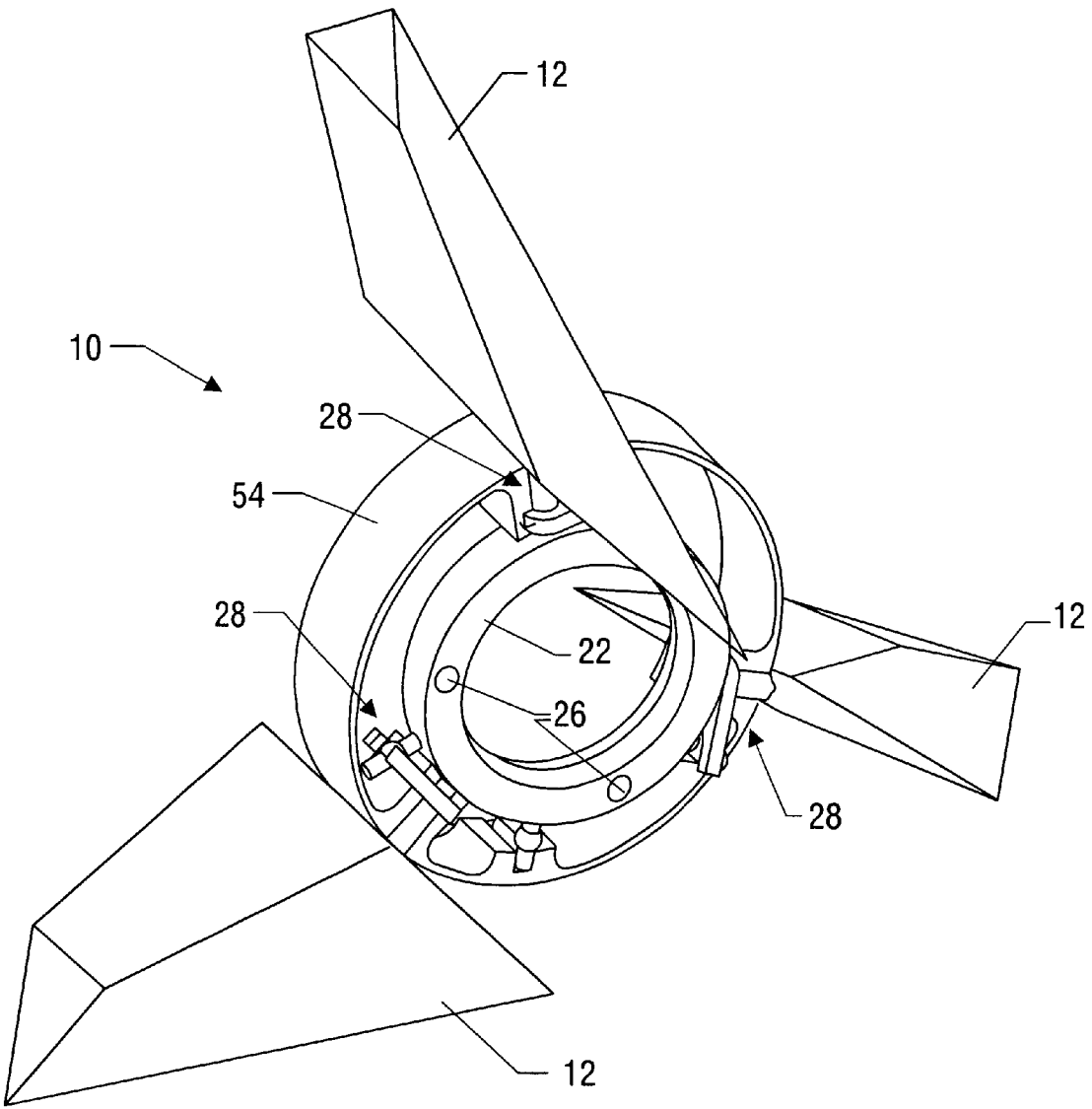
FIGS. 5A–C show the fins of the fin control system in FIGS. 1–3 in a positive pitch deflection.
Figure 5B:
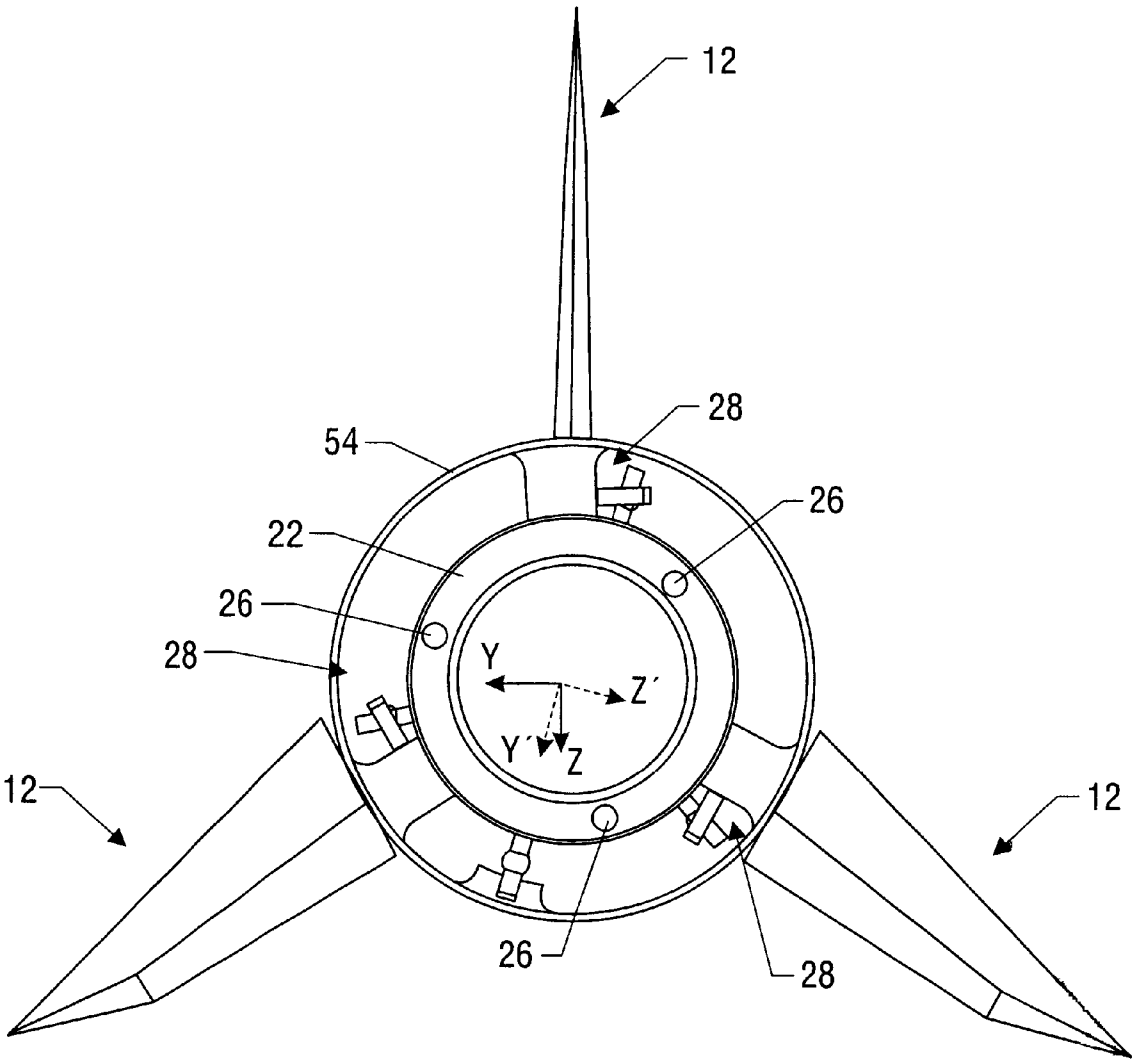
Figure 5C:
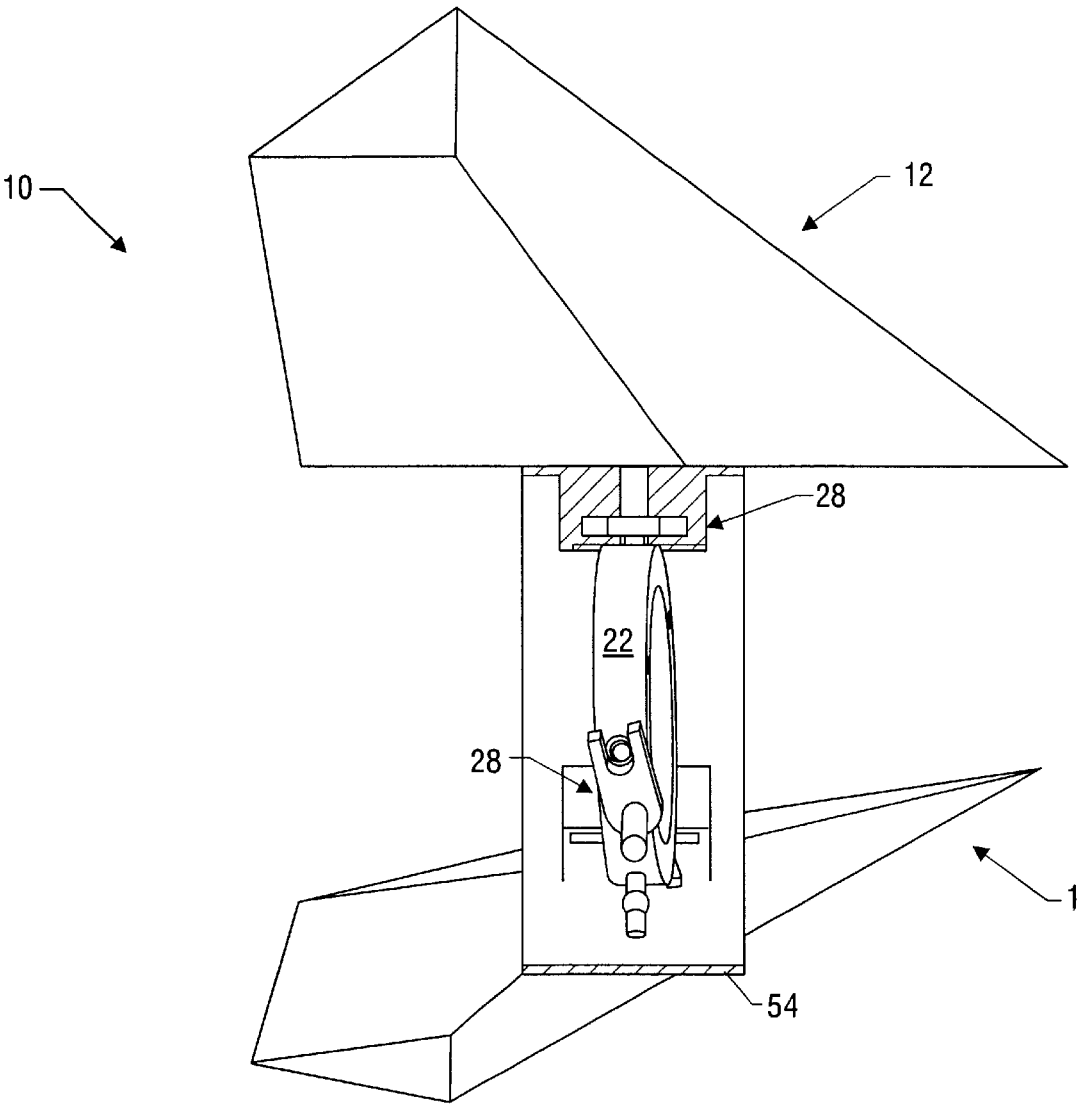
Figure 6A:
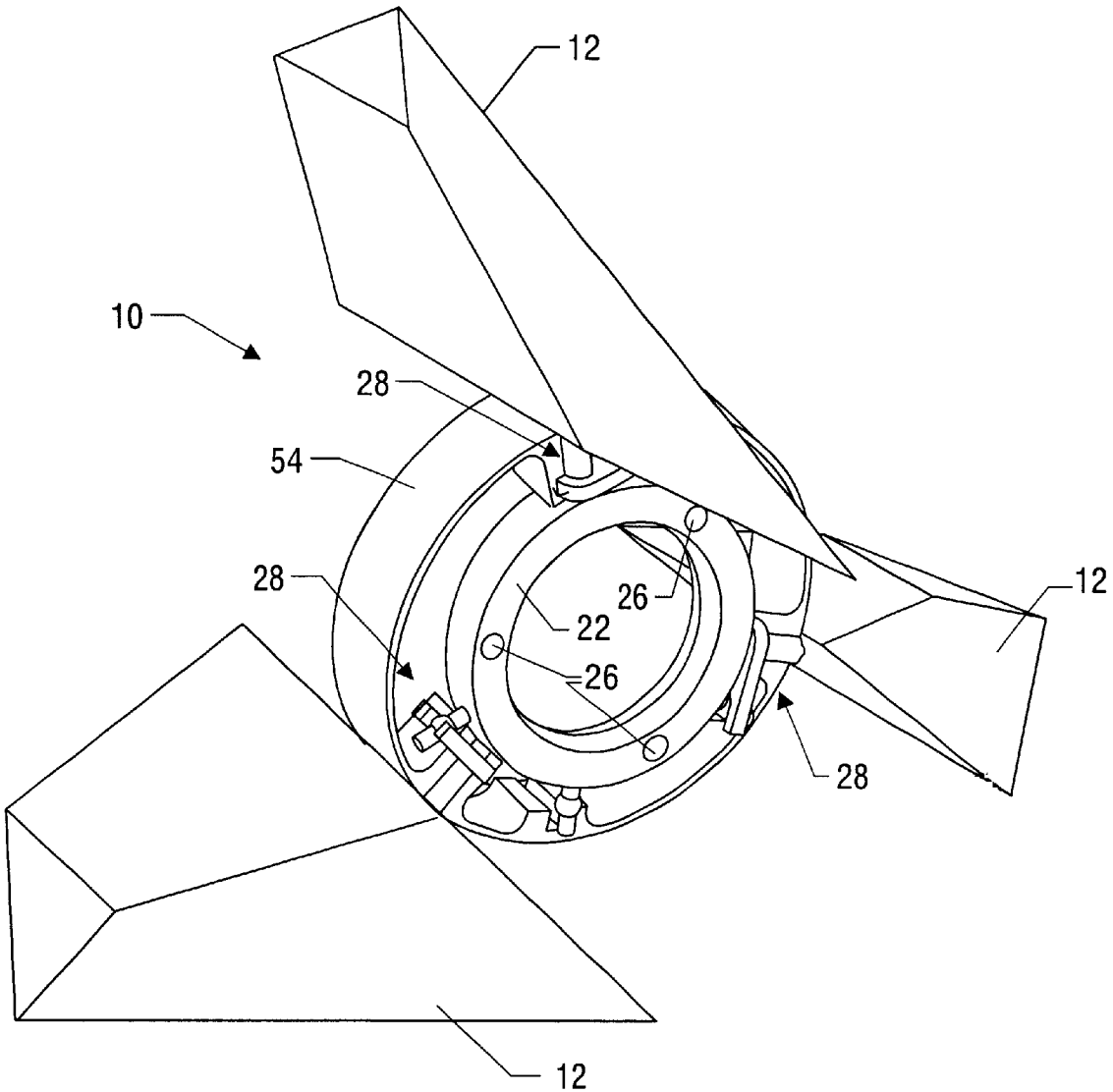
FIGS. 6A–C show the fins of the fin control system in FIGS. 1–3 in a positive yaw deflection.
Figure 6B:
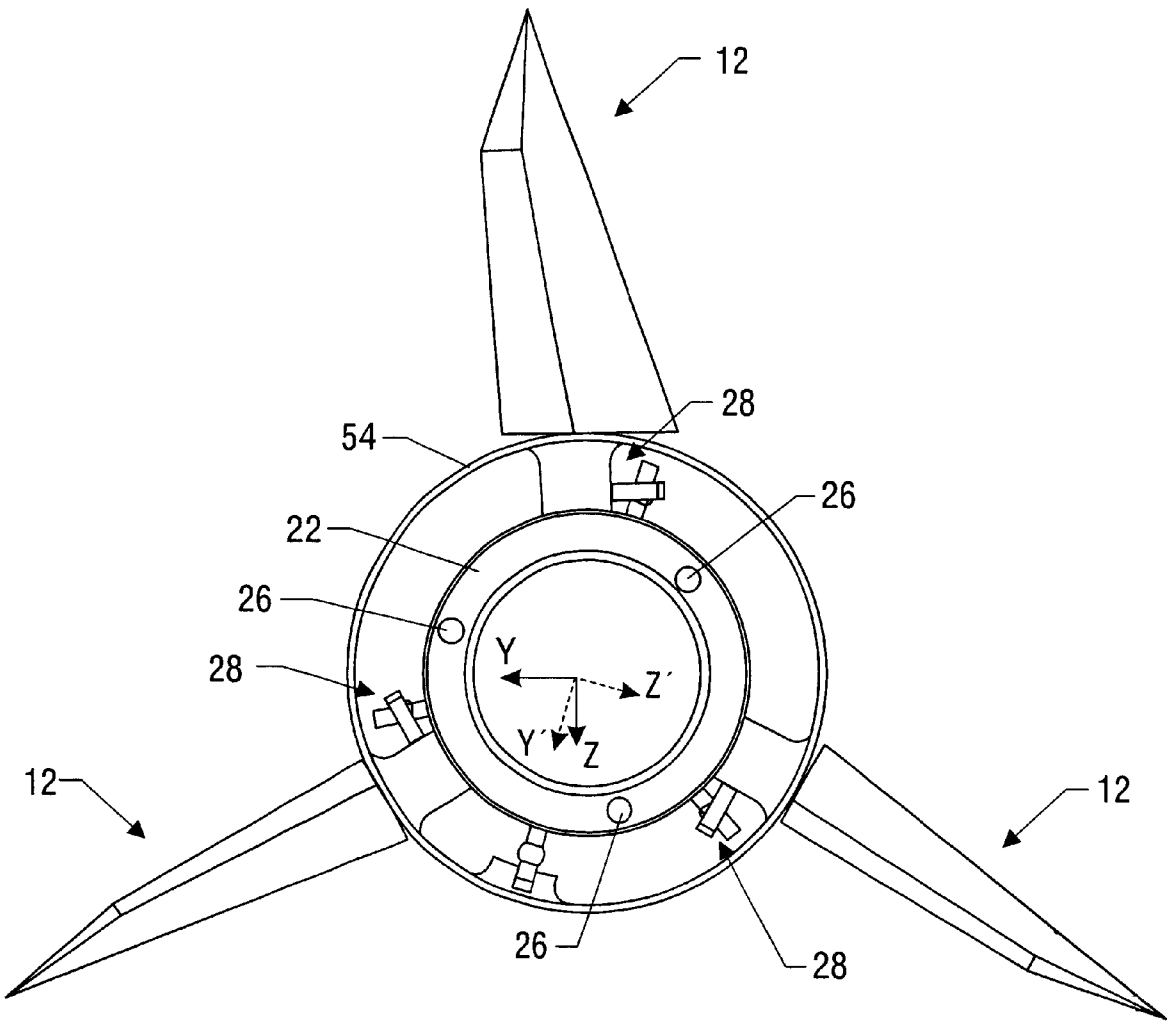
Figure 6C:
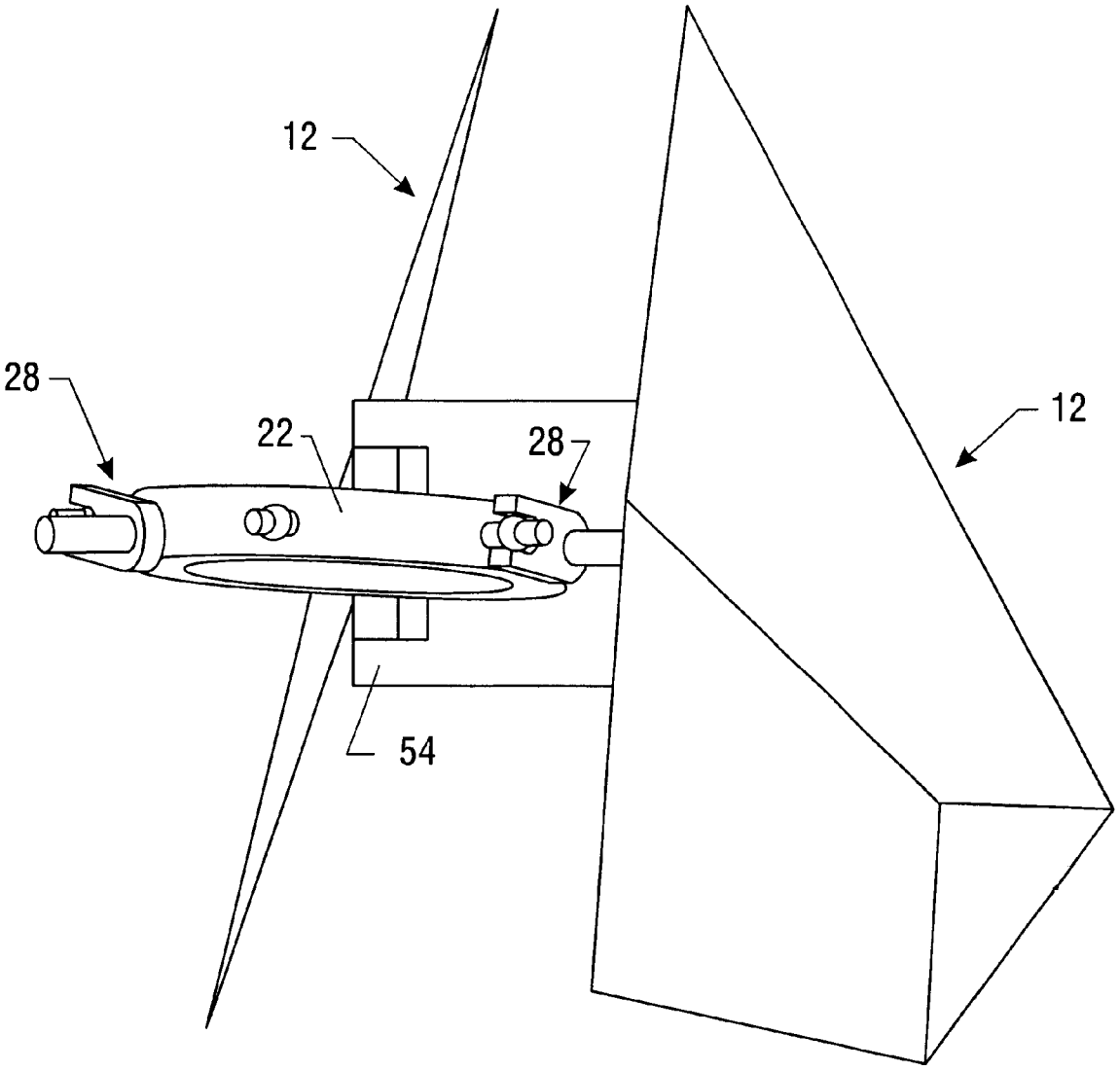

Thus, in operation, the actuation plane 22 is displaced at one or more of the points 26. This displacement is communicated to the fins 12 via the linkage 28. More particularly, the displacement is communicated through the bearings 36 between the pins 30 and the forks 32. The pin 48 in the track 50 of the guide 52 prevents the actuation plane 22 from freely rotating in the defined y-z plane about the x-axis while otherwise permitting displacement as discussed above. FIGS. 1–3, 4A–C, and 5A–C, 6A–C illustrate operation of the invention in the context of the control system 10. More particularly:

FIGS. 1–3 show the fins 12 in an undeflected position;

FIGS. 4A–C show the fins 12 in a positive roll deflection;

FIGS. 5A–C show the fins 12 in a positive pitch deflection through rotation about the defined y'-axis in positive direction; and FIGS. 6A–C show the fins 12 in a positive yaw deflection through rotation about the defined z'-axis in a negative direction.

Each of the roll, pitch, and yaw attitudes of the control system 10 is controlled, as mentioned above, by the displacement of the actuation plane 22.

Figure 7:
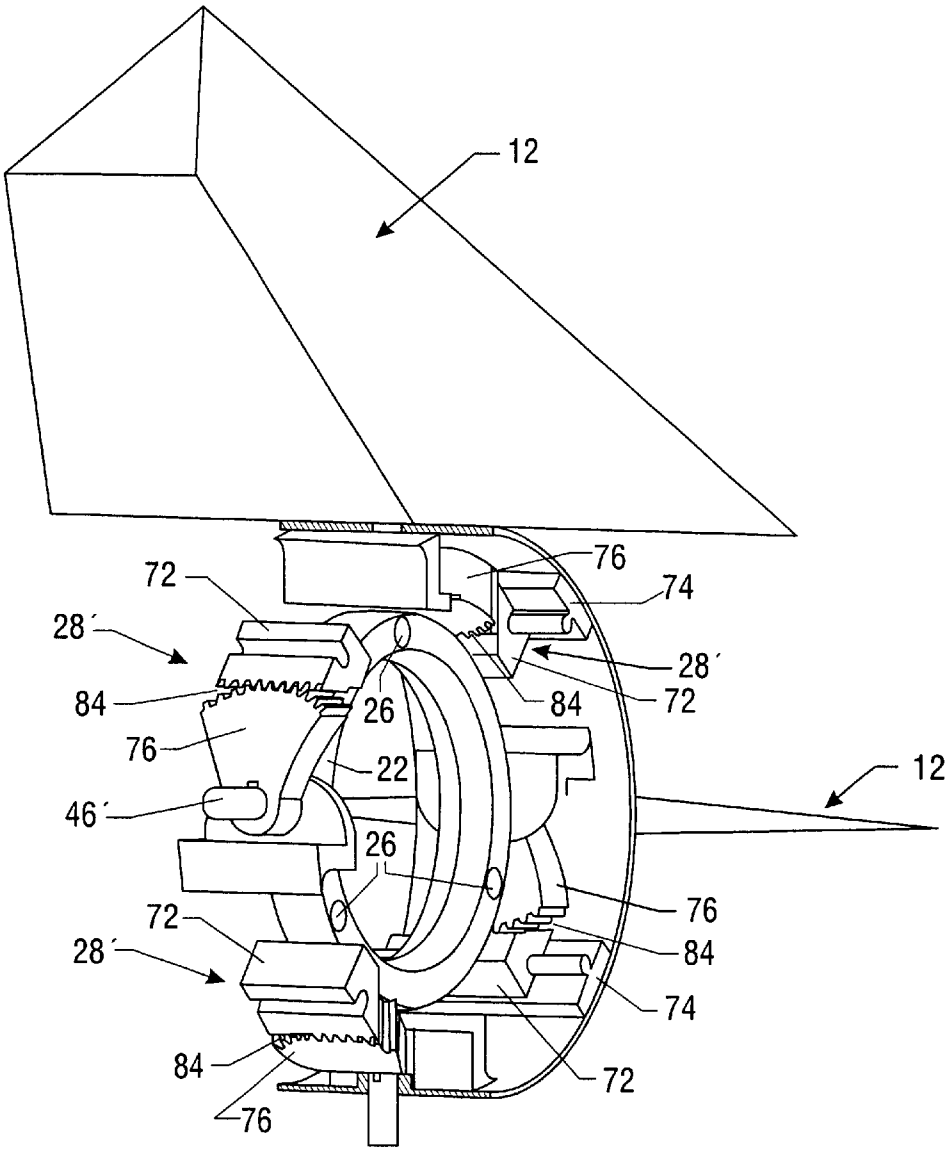
FIGS. 7–9 illustrate a second embodiment of a non-propulsvie fin control system constructed and operated in accordance with the present invention.
Figure 8:
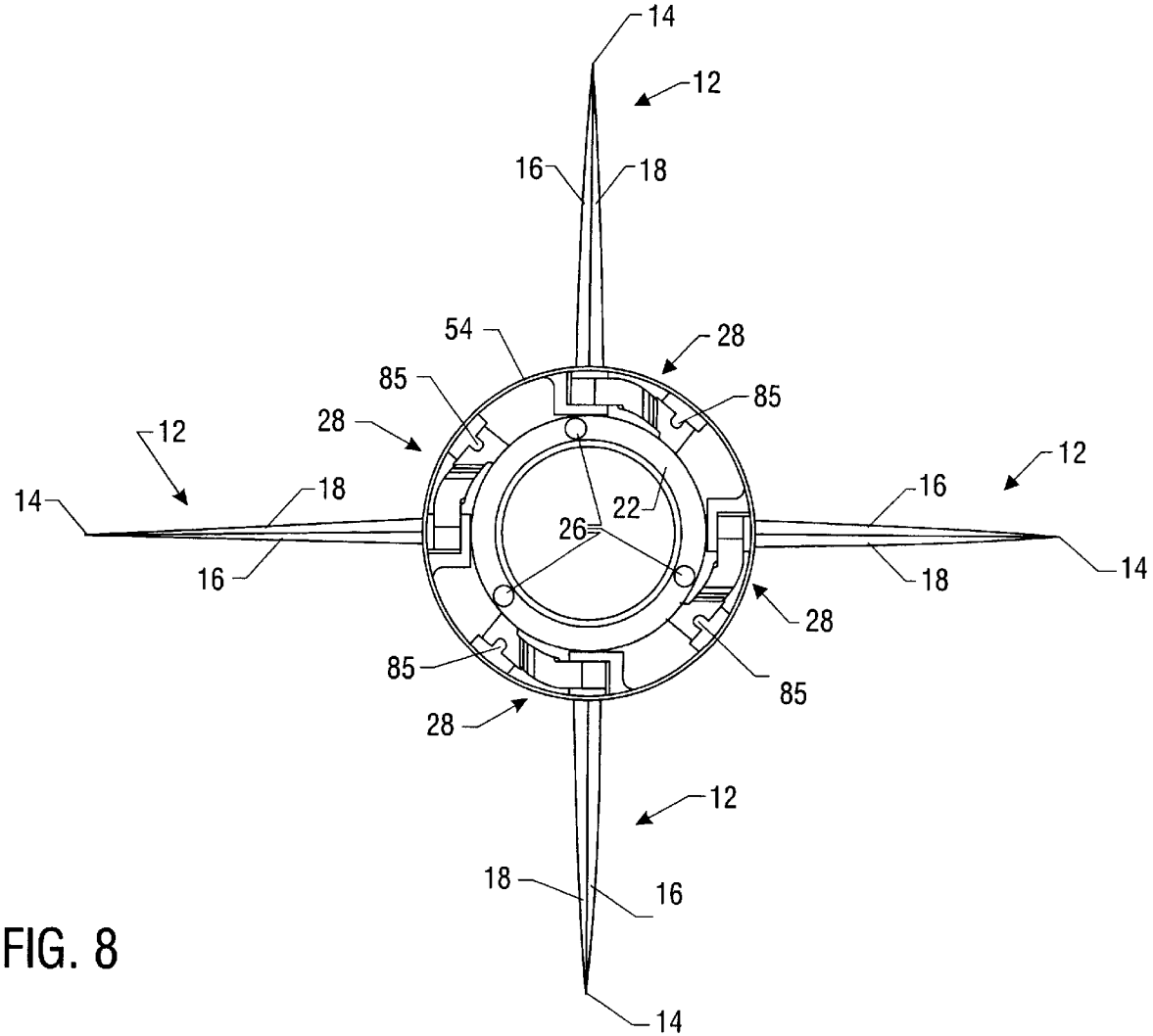
Figure 9:
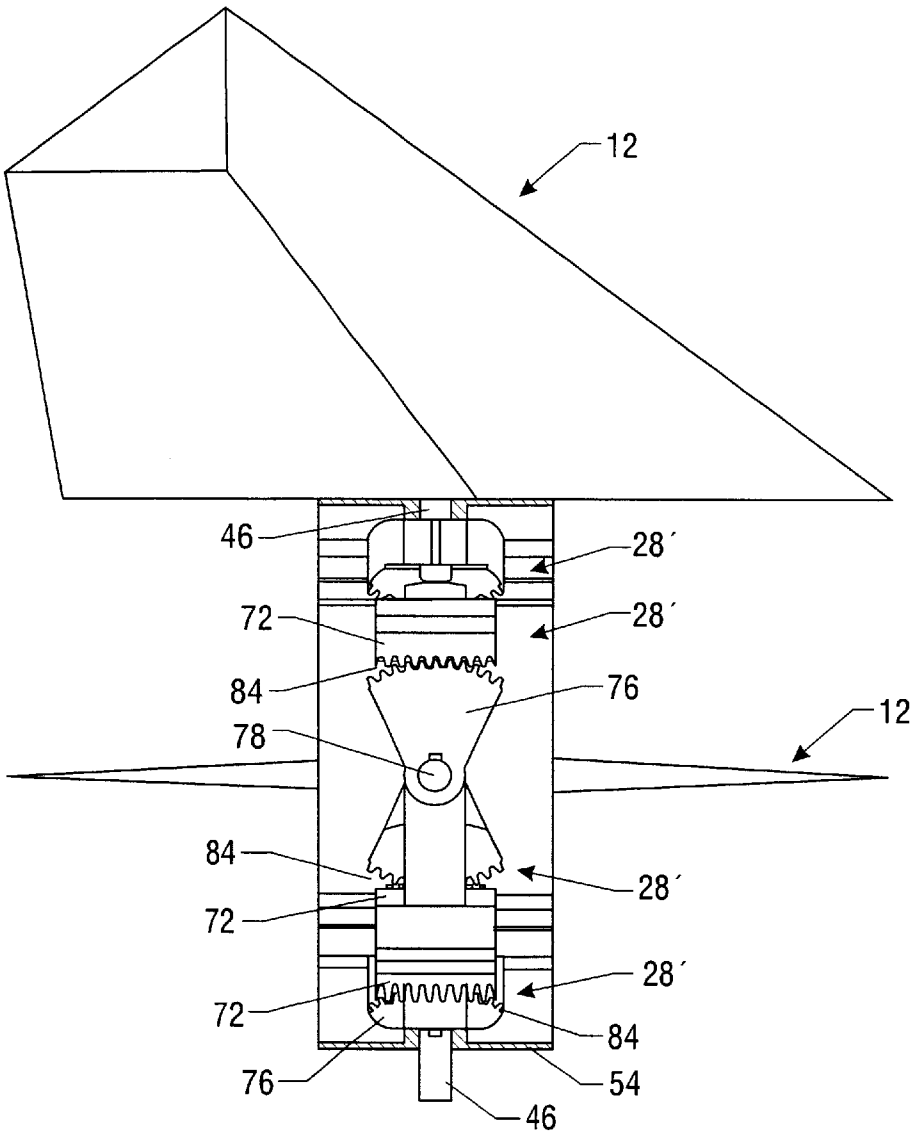

FIGS. 7–9 illustrate a non-propuslive fin control system 10' employing an alternative embodiment 28' of the linkage 28. The linkage 28' of this embodiment generally includes a rack 72, a rack guide 74, and a pinion gear 76. The rack 72 is operatively coupled to the actuation plane 22 by a pin 78 extending from the rack 72 into a socket 75 in the actuation plane 22. The pin 78 has a spherical head 85 that, in combination with the socket 75, permits properly constrained motion between the rack 72 and the actuation plane 22 as the actuation plane 22 is displaced. The rack 72 is operatively coupled to the pinion gear 76 by a toothed interface 84 such that the rack 72 and the pinion gear 76 form a rack and pinion. The actuation mechanism (not shown) may, in various embodiments, be electromagnetic, electromechanical, purely mechanical, hydraulic, or pneumatic.

Figure 16A:
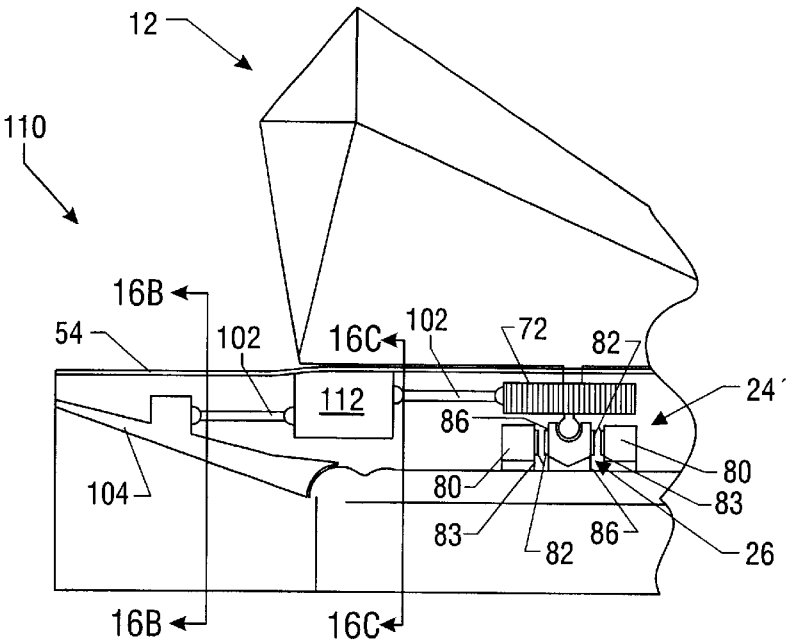
FIG. 16A–C illustrate how second alternative embodiment of the invention may be employed to control a vehicle's thrust vector control system.

FIG. 16A illustrates, in part, an alternative embodiment 24' of the actuation mechanism 24 as employed in the embodiment 10'. This actuation mechanism 24' includes two plates 80 bracketing the actuation plane 22. Each point 26 in this particular embodiment is constructed from paired electromagnets 82. More particularly, the interior surface 83 of each plate 80 has mounted thereon at least three electromagnets 82. Both sides 86 of the actuation plane 22 have mounted thereon, opposed to the electromagnets 82 mounted on the plates 80, at least three electromagnets 82. The polarities of the paired electromagnets 82 may be manipulated so that the paired electromagnets 80 attract and repel in a predetermined pattern to displace the actuation plane 22 by pushing and pulling it. The mounting and powering of the electromagnets 80 will be implementation specific and may be any suitable technique known to the art. This embodiment of the actuation mechanism 24' may also be controlled using any suitable technique known to the art and will be implementation specific. This embodiment may also be controlled responsive to commands issued by a person or a computer (not shown).

Figure 10A:
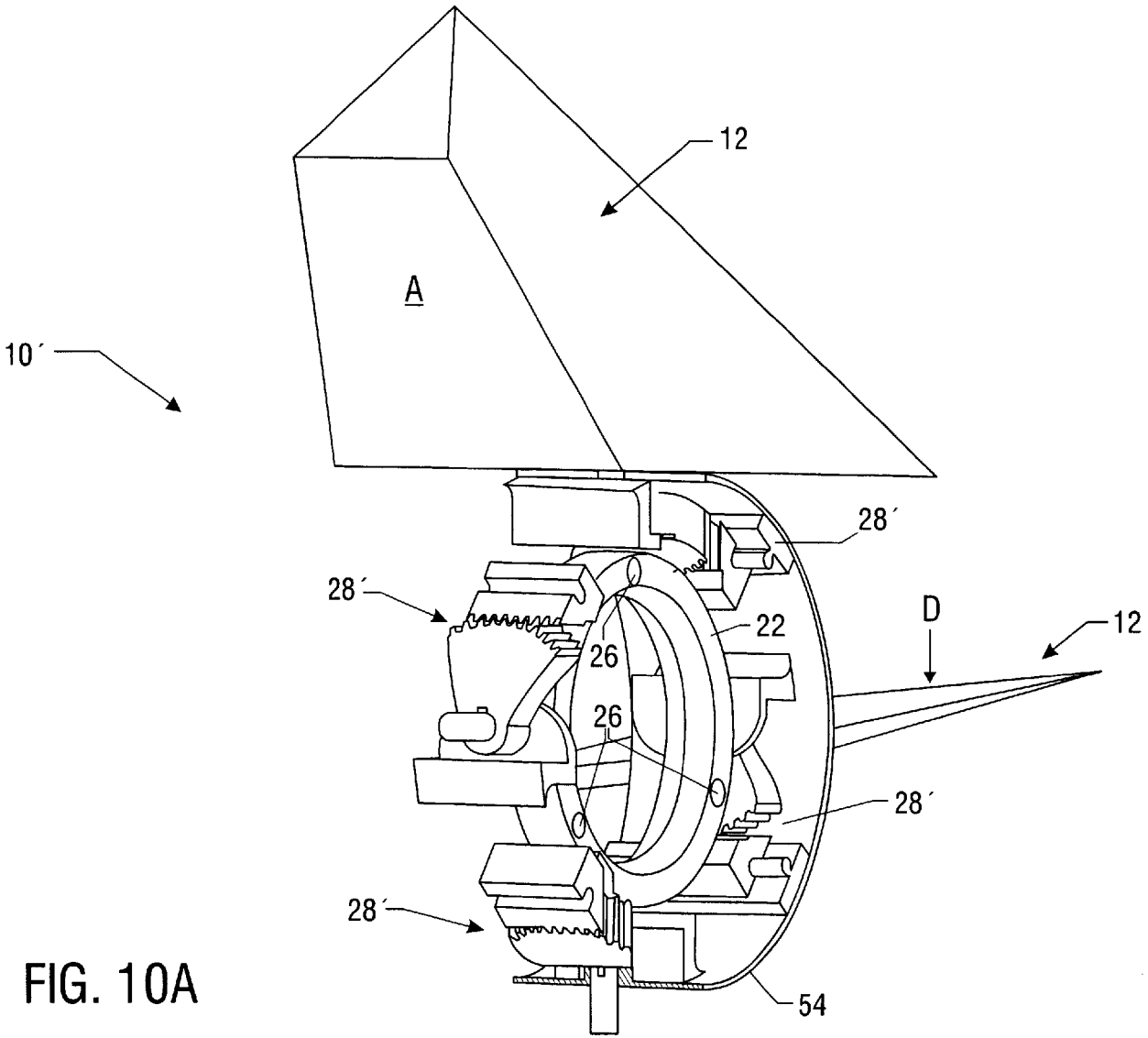
FIGS. 10A–C illustrate the embodiment of FIGS. 7–9 in a positive roll deflection.
Figure 10B:
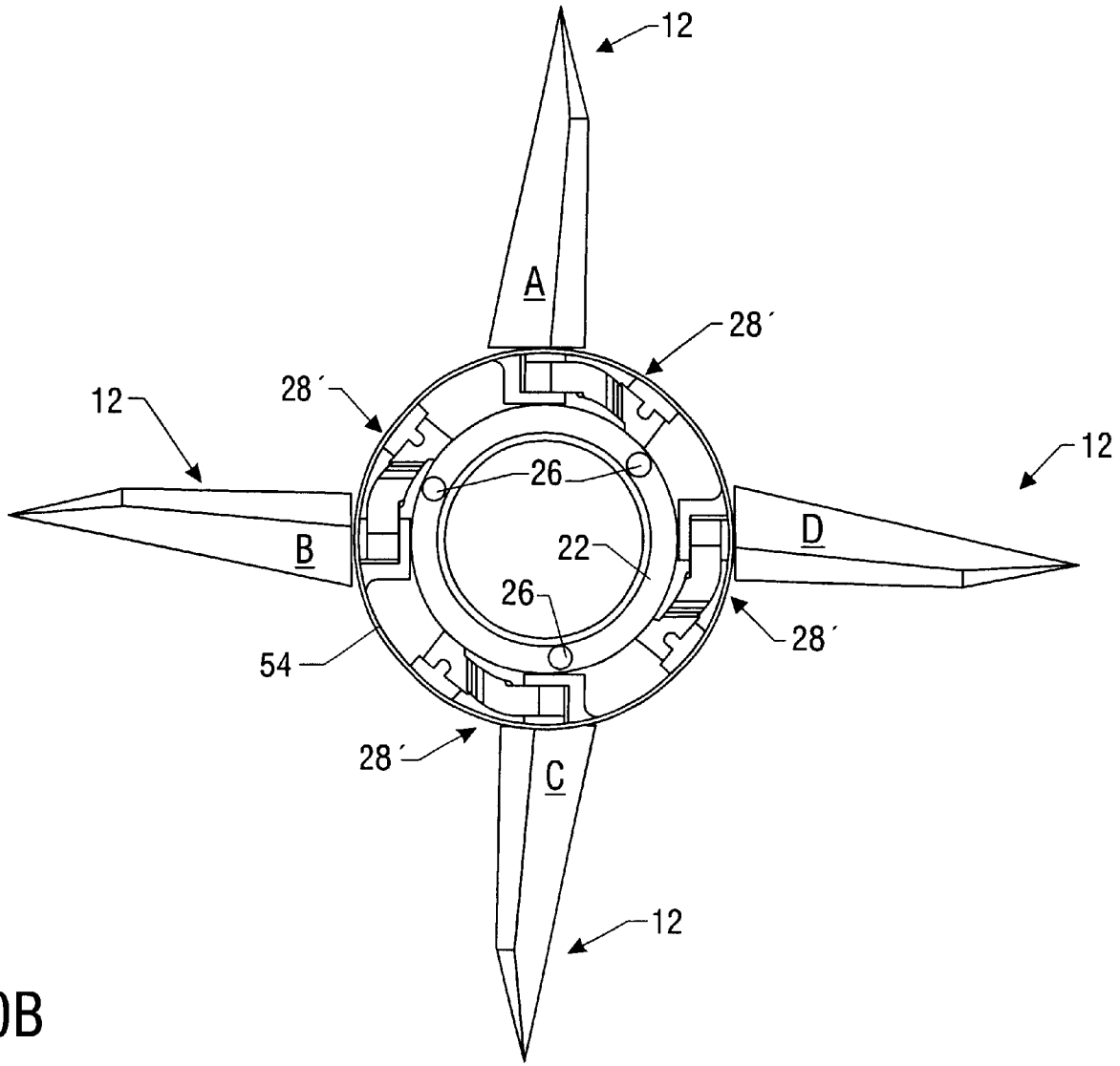
Figure 10C:
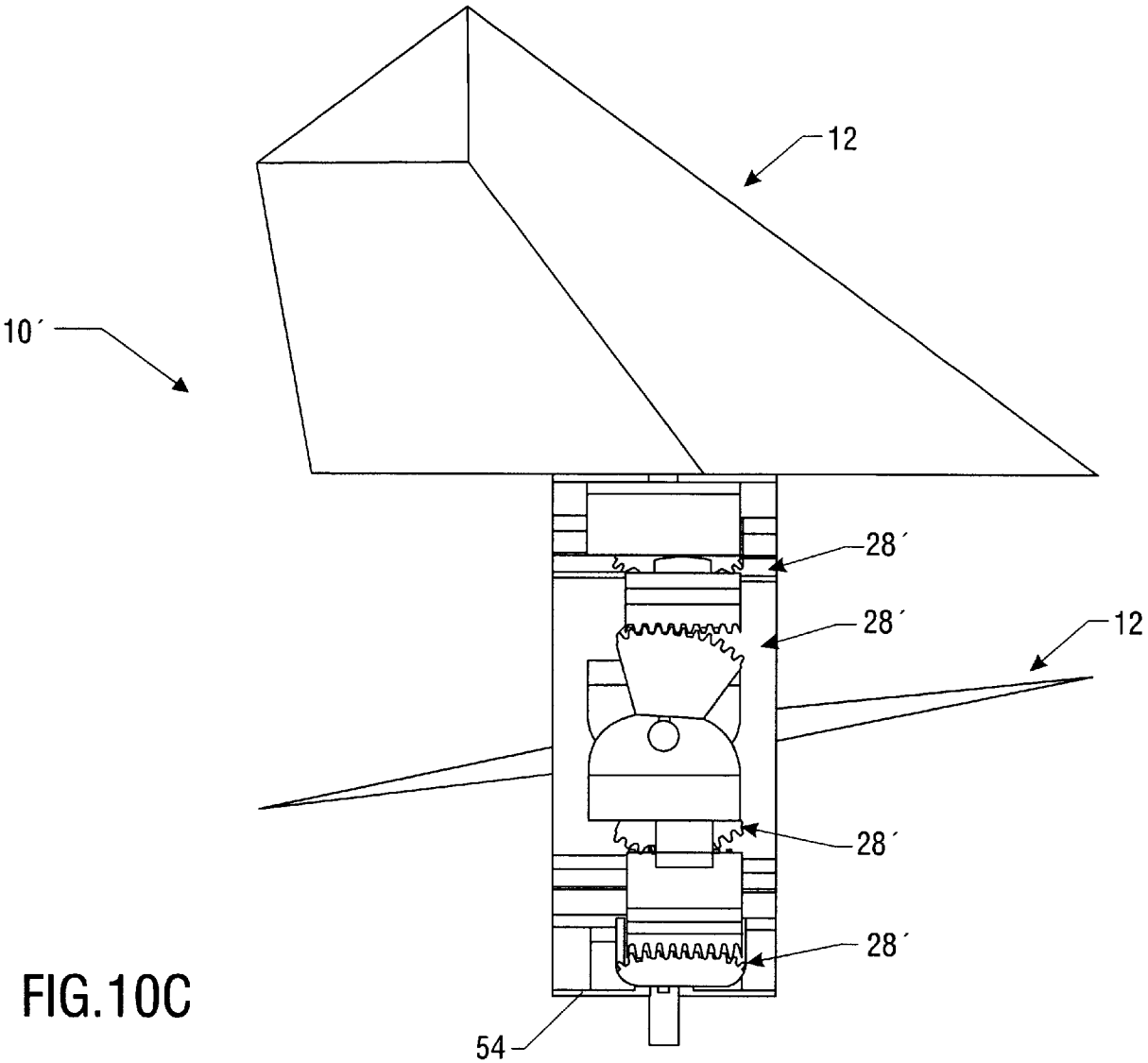
Figure 11A:
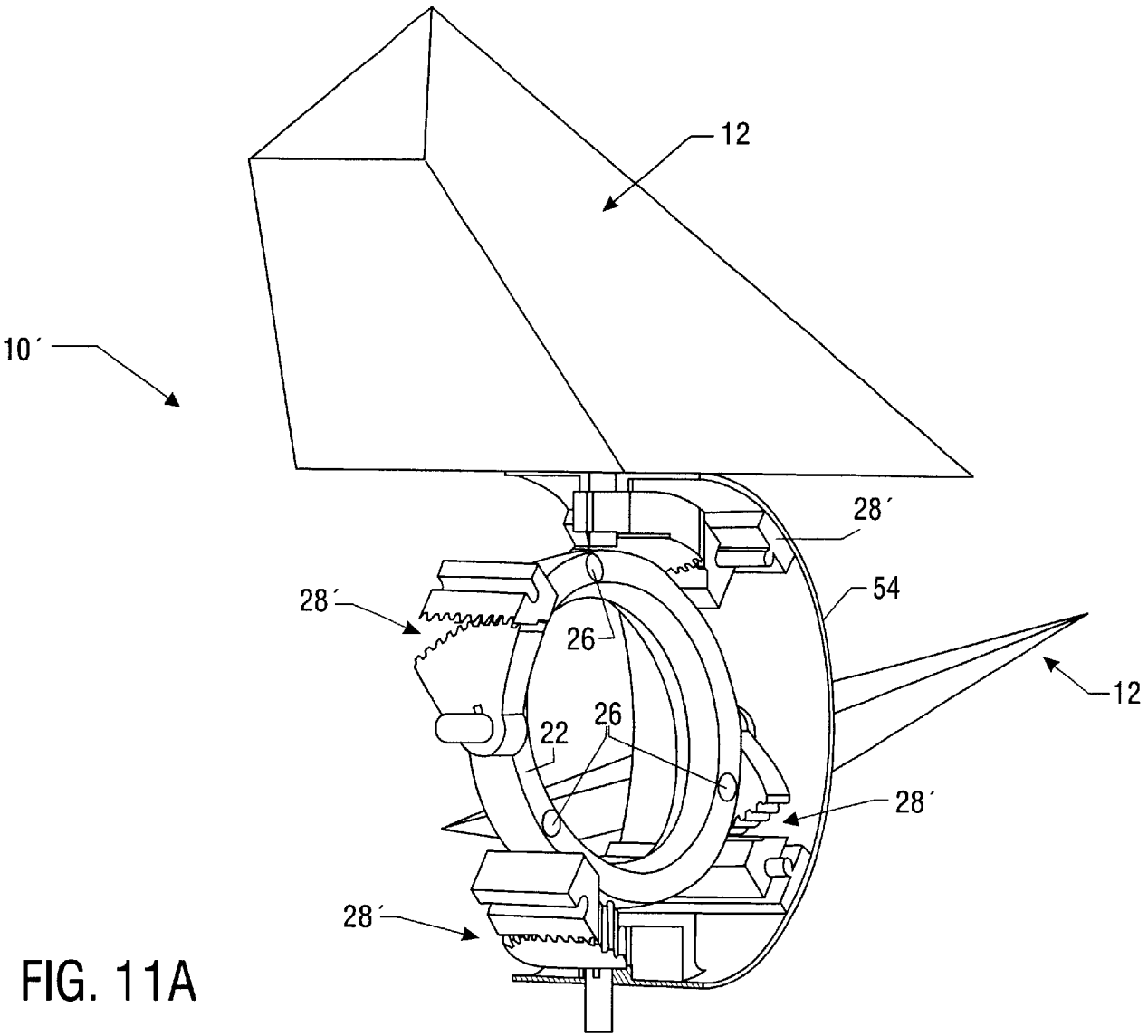
FIGS. 11A–C illustrate the embodiment of FIGS. 7–9 in a positive pitch deflection.
Figure 11B:
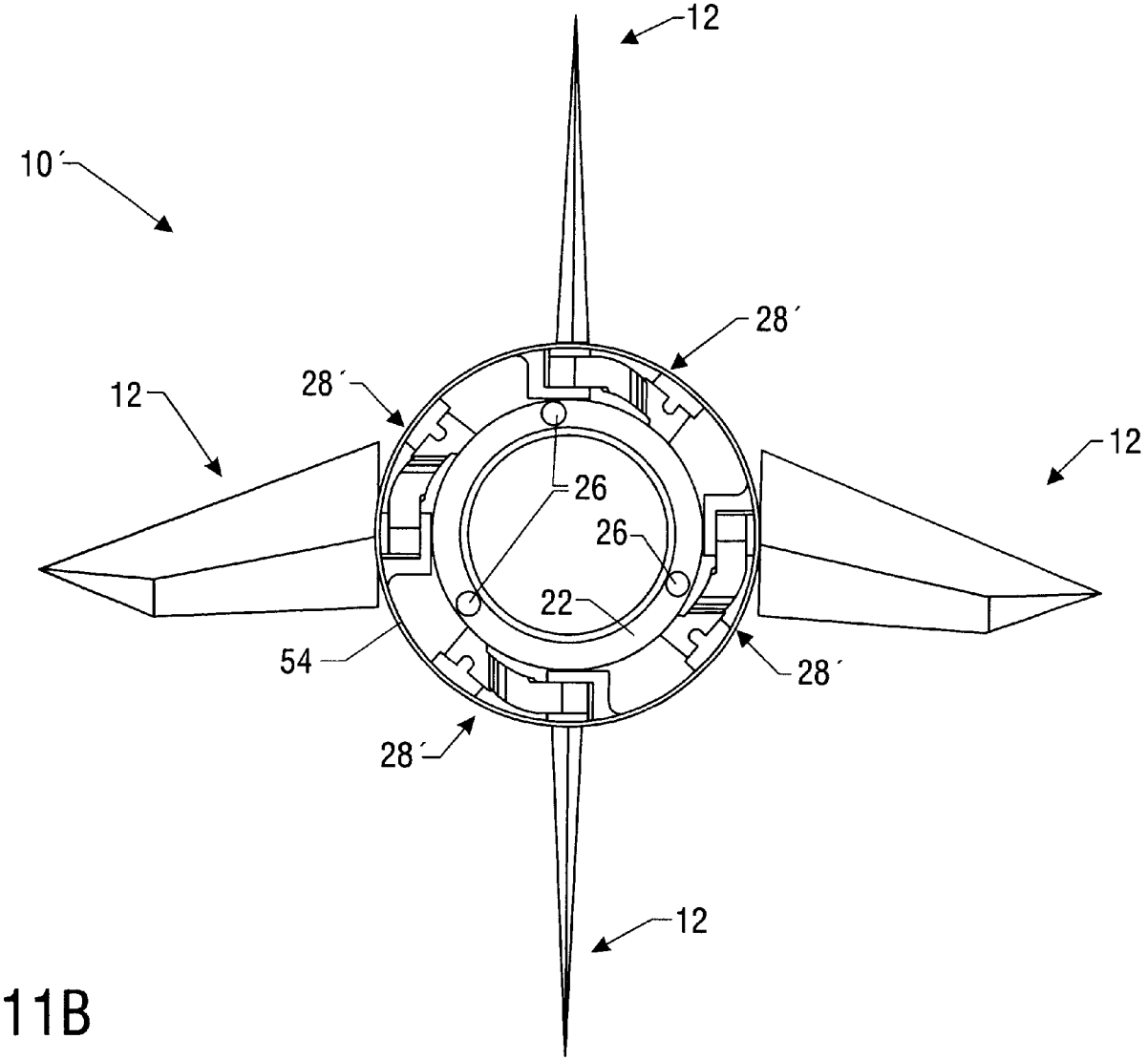
Figure 11C:
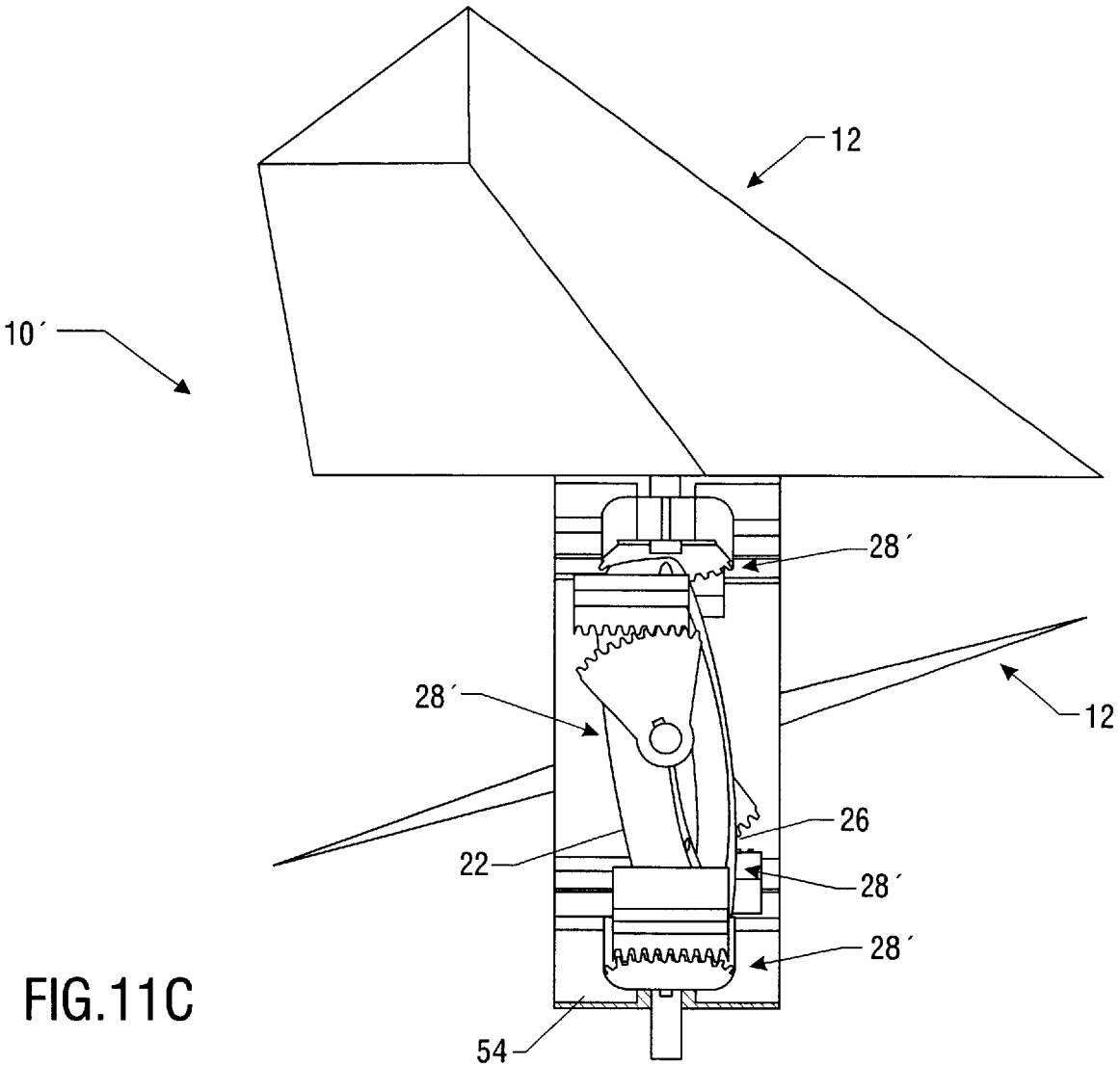
Figure 12A:
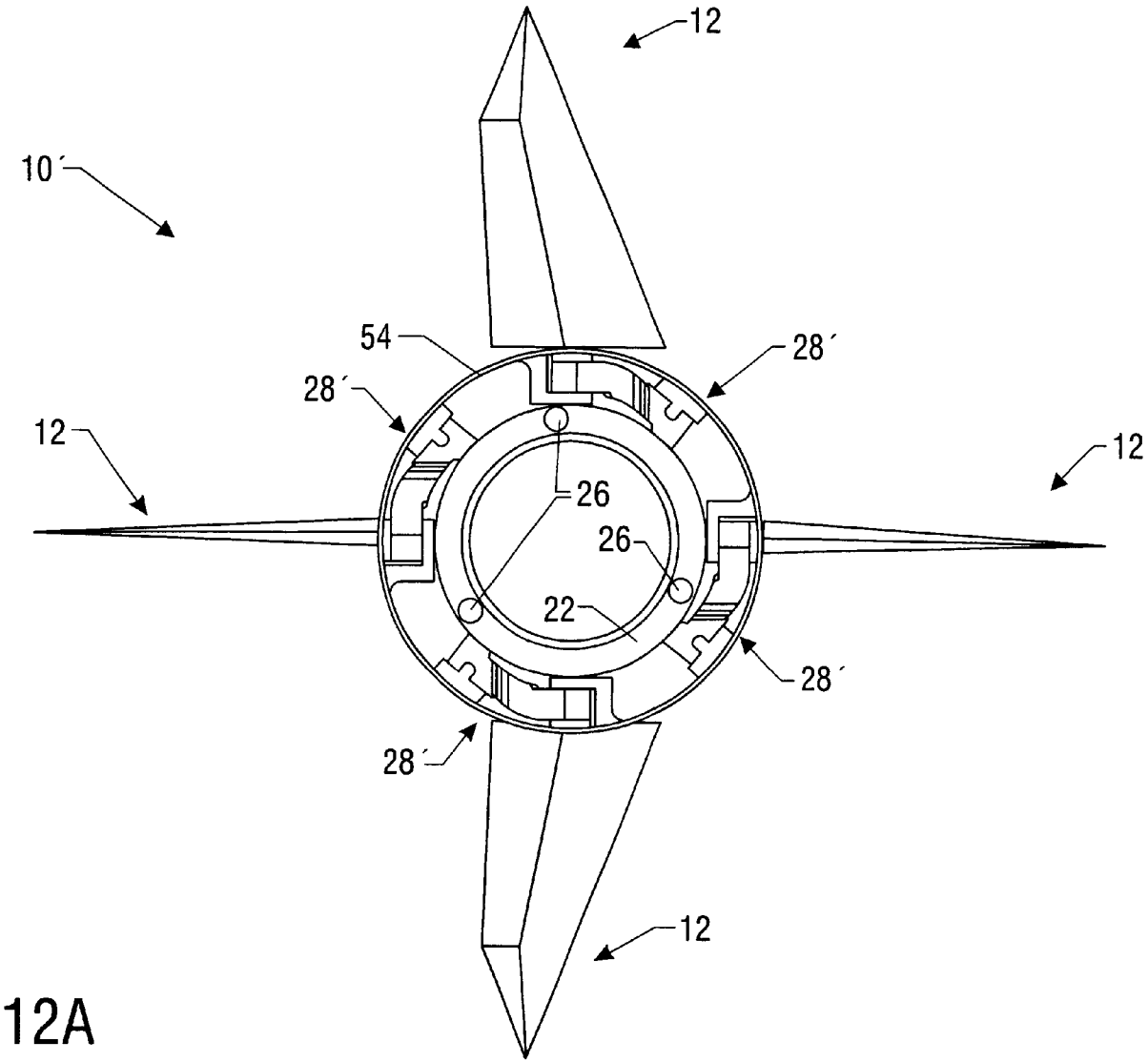
FIGS. 12A–B illustrate the embodiment of FIGS. 7–9 in a positive yaw deflection.
Figure 12B:
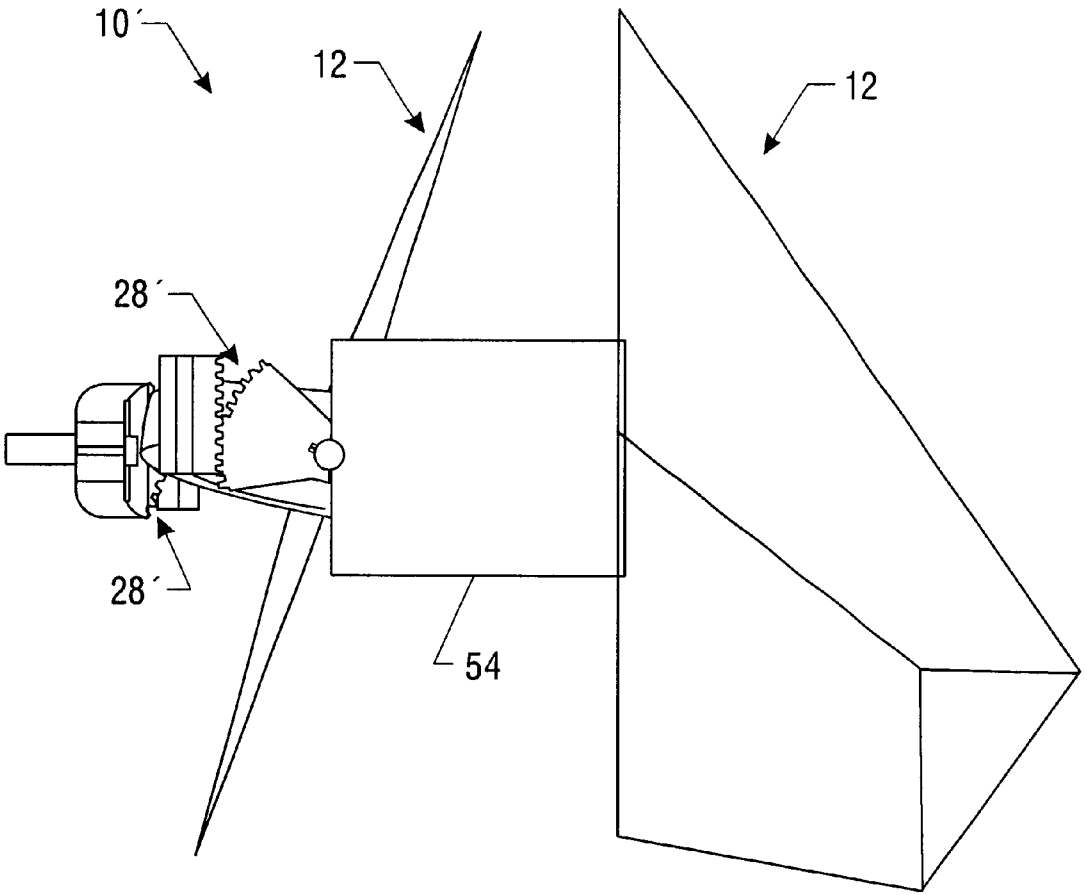
Figure 13:
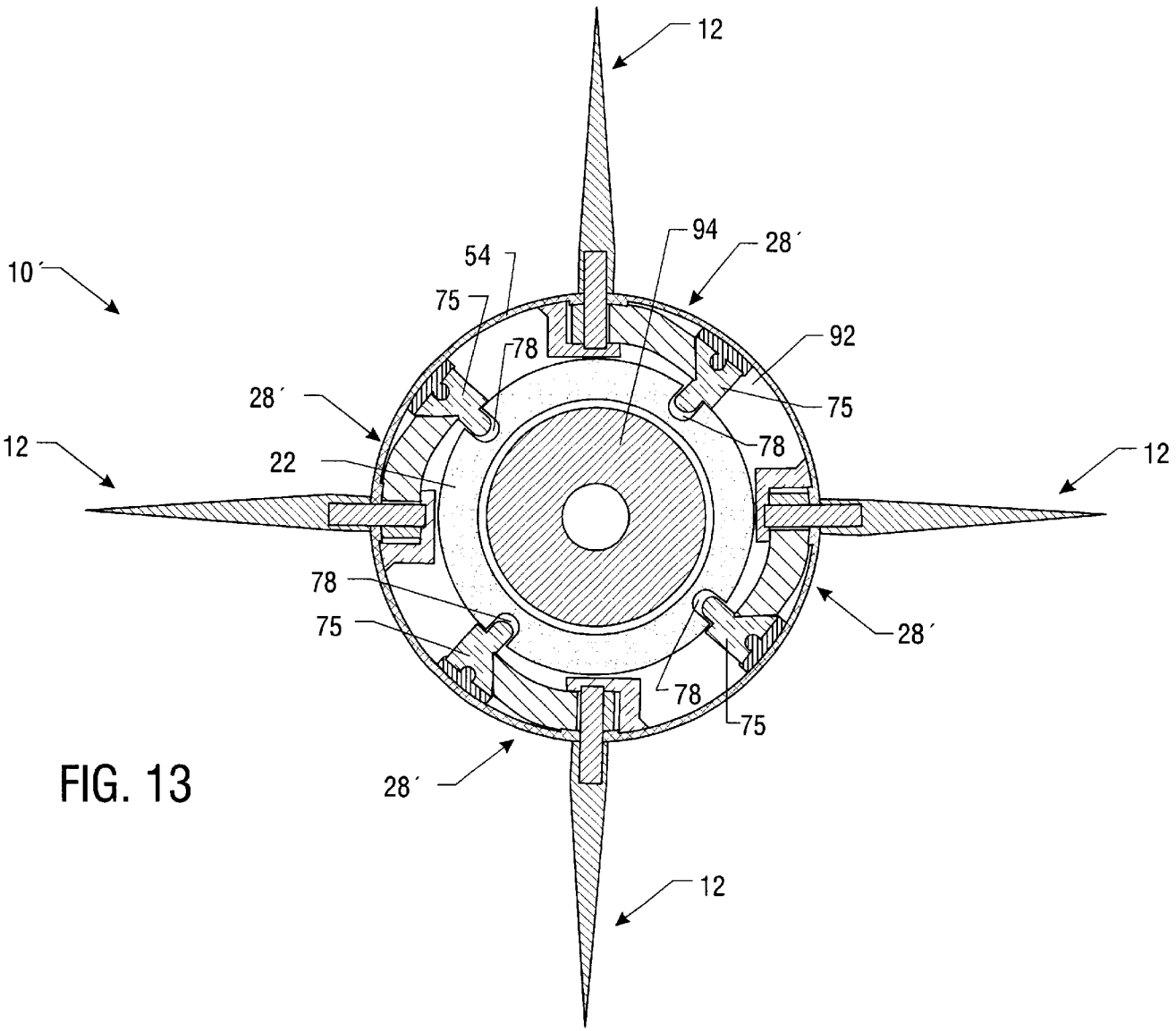
FIGS. 13–14 are cross-sectional, plan views of various alternative embodiments of the vehicle illustrated in FIGS. 7–9 employing the invention to control four and six fins, respectively.

FIGS. 7–9, 8A–B, 10A–C, and 10A–B illustrate operation of the invention in the context of the four fin implementation 90 of FIG. 13. More particularly:

FIGS. 7–9 show the fins 12 in an undeflected position;

FIGS. 10A–C show the fins 12 in a positive roll deflection;

FIGS. 11A–C show the fins 12 in a positive pitch deflection through rotation about the defined y'-axis in the positive direction; and FIGS. 12A–B show the fins 12 in a positive yaw deflection through rotation about the defined z'-axis in a negative direction.

Each of the roll, pitch, and yaw attitudes of the control system 10 is controlled, as mentioned above, by the displacement of the actuation plane 22.

Figure 14:
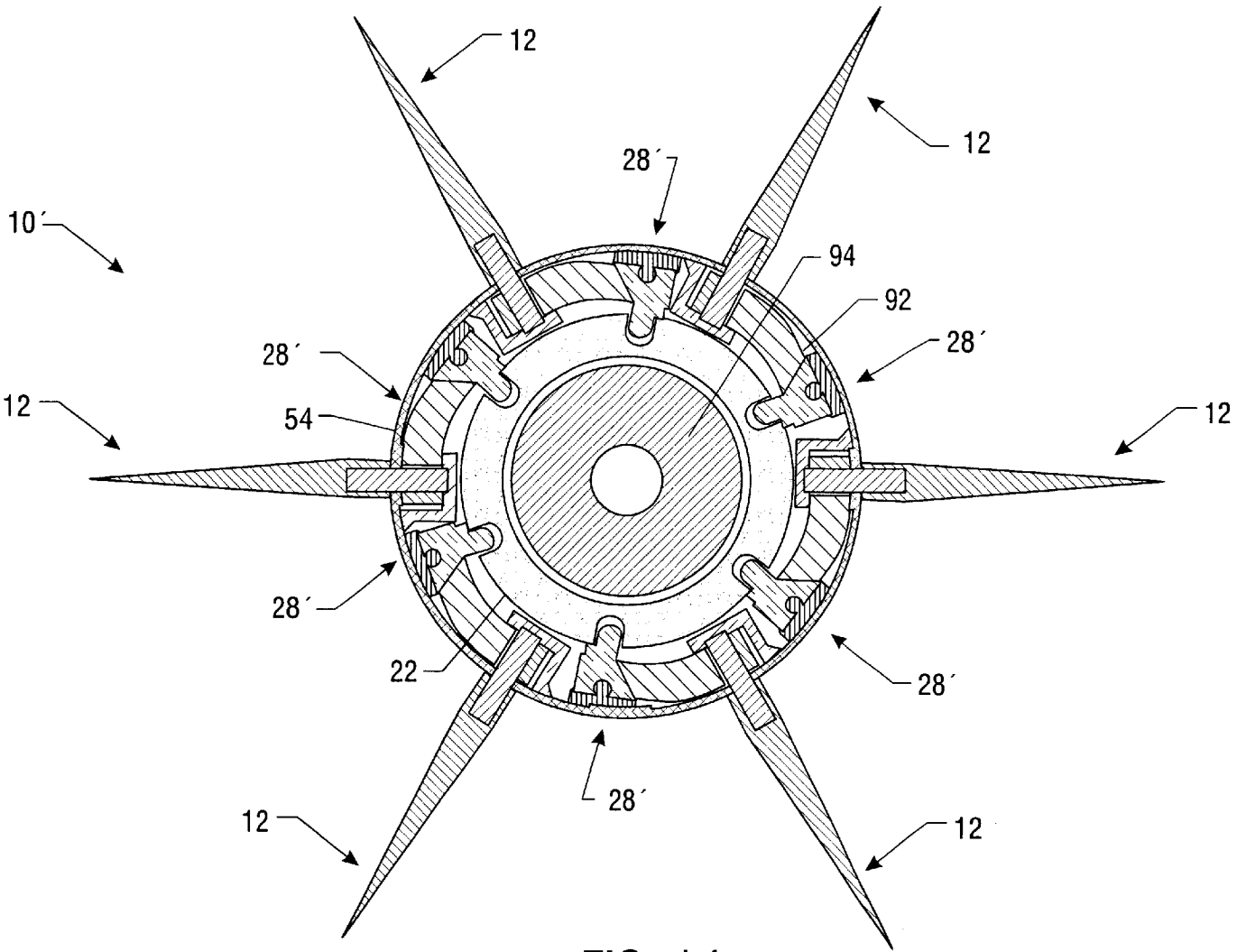

This particular embodiment may be employed in implementations having an even number of fins 12 greater than three. FIGS. 13–14 are cross-sectional plan views of various alternative embodiments of the system 10' illustrated in FIGS. 7–9 employing the invention to control four and six fins 12, respectively. Each fin 12 is associated with an individual linkage 28', but only a single actuator 20', in each embodiment 10'. Each actuator 20' is displaced longitudinally in at least three points 26, not necessarily all simultaneously, to control the yaw, pitch, and roll of the embodiment 10'. The invention consequently reduces the weight and complexity of actuating the fins 12 relative to the prior art by eliminating redundant actuation mechanisms. The linkages 28' in these particular embodiments are mounted to the interior surface 102 of the missile fuselage 54 in the annulus 92 defined by the actuator 20' and the fuselage 54. The actuation plane 22 of the actuator 20' encircles the rocket motor blast tube 94 in these particular embodiments.

As is apparent from the discussion regarding the actuation plane 22 and the actuation mechanism 24, the invention contemplates some variation of certain structure among the many possible alternative embodiments. Embodiments of the actuation mechanism 24 alternative to those discussed above are contemplated and are considered to be within the scope and spirit of the invention as claimed below. The actuation mechanism 24 of FIGS. 1 and 16A are merely representative embodiments. Indeed, the precise structure of the actuation mechanism 24 is not material to the practice of the invention in all embodiments. The two embodiments of the actuation mechanism 24 disclosed in FIGS. 1 and 16A each comprise, by way of example and illustration, a particular means for displacing the actuation plane 22. Similarly, the linkage 28, including the rack 72, rack guide 74, and pinion gear 76, comprise a particular embodiment of a means for linking the actuator to the fins 12, again by way of example and illustration. Each of these variations, as well as others, are considered to be within the scope and spirit of the invention set forth below.

Thus, the fins 12 and, hence, the flight control surfaces 16 and 18, are controlled by actuating the plane 22. More precisely, the fins 12 are controlled by selectively displacing the actuation plane 22 rather than rotating the fins 12 themselves, and the movement of the actuation plane 22 is then transferred over the linkage 28 to the fins 12. By selectively displacing the actuation plane 22, the actuation plane 22 can be rotated two-dimensionally to control yaw and pitch and translated longitudinally to control roll, all with a single actuator 20 controlling all the fins 12. The invention, in its various embodiments, removes the design constraint of one actuator motor per fin 12.

Figure 15A:
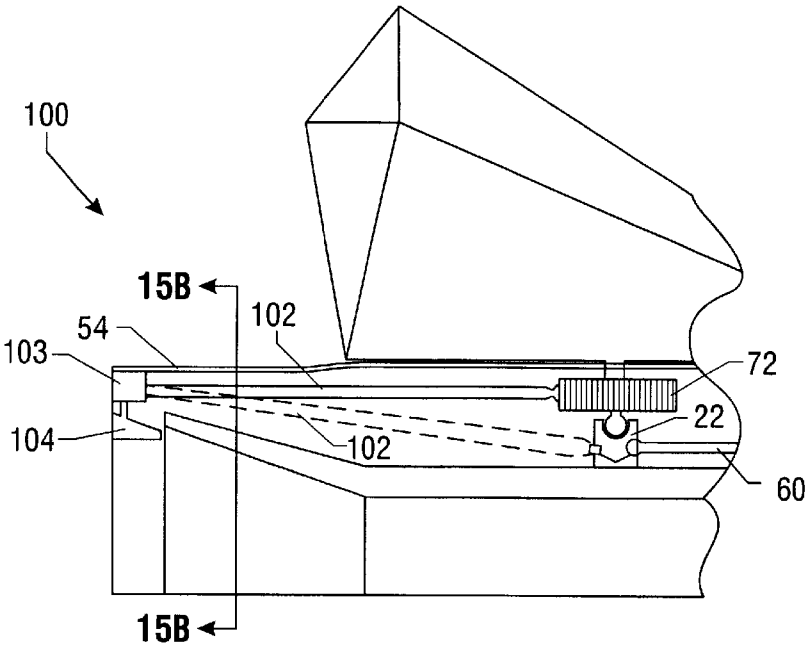
FIGS. 15A–B illustrate how another alternative embodiment that may be employed to steer a nozzle thrust vector control system.
Figure 15B:
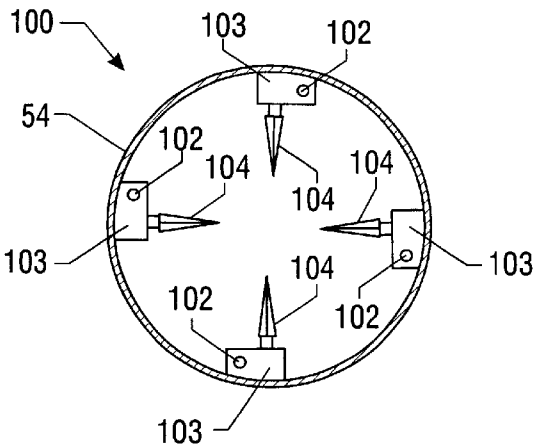

FIGS. 15A–B illustrates an alternative embodiment in which the control system 100 of FIGS. 7–9 may be employed to control a missile's thrust vector control system 100. The rack 72 is operatively coupled to a push rod 102, although the push rod may alternatively be coupled to the actuation plane 22 in some embodiments as shown in ghosted lines. The push rod 102, in turn, is operatively coupled to a jet vane 104 of a thrust vector control system through a gear box 103 that converts the motion of push rod 102 to rotation of the jet vane 104. As the actuation plane 22 is displaced, the rack 72 reciprocates on the rack guide 74 and moves the push rod 102 therewith. This reciprocal movement is communicated to the jet vane 104 via the gear box 103 to control the thrust vector.

Figure 16B:
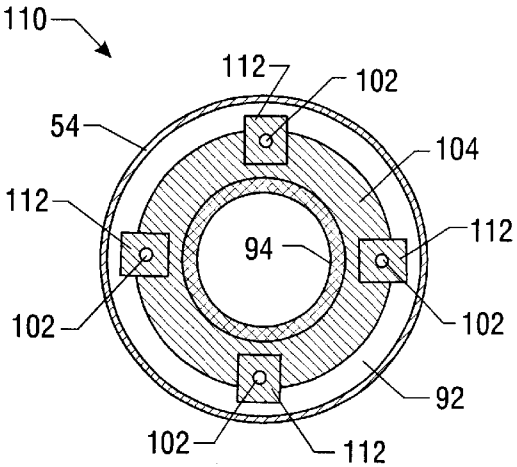
Figure 16C:
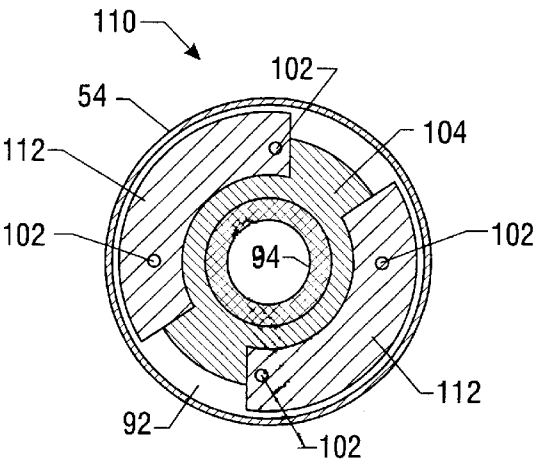

Returning now to FIGS. 16A–C, another alternative embodiment of the invention as may also be used to control a steerable nozzle thrust vector control system 110 is disclosed. The gear box 112 is operatively coupled to the nozzle 114 and the rack 72 and reduces the planar motion to planar rotations. Thus, translations of the actuation plane 22 produce no output from the gear box 112 while planar rotations produce pitch and yaw nozzle deflections.

Thus, in the embodiments of FIGS. 13A–B, and 8A–C, the fins 12 and the thrust vector may be controlled using a single actuator to actuate them using a plane. The particular implementation of the invention in FIGS. 13A–B enables implementation of fin control systems having three or more fins 12 and/or three or more thrust vector control vanes 104. The implementation of the invention in FIGS. 8A–C manifests this advantage as well. Note that the number of fins 12 and the number of thrust vector control vanes 104 need not be coincident and, in various embodiments, may differ.

It is therefore apparent that the particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. An apparatus for controlling the direction of an air or sea vehicle, the apparatus comprising:

an actuator, including:

an actuation plane; and an actuation mechanism, capable of displacing the actuation plane at three points;

at least three non-propulsive fins; and a linkage between the actuator and each one of the fins, the linkage communicating the actuation plane's displacement to the respective one of the fins.

2. The apparatus of claim 1, wherein the actuation mechanism comprises a means for displacing the actuation plane.

3. The apparatus of claim 2, wherein the means for displacing is selected from the group of:

two plates bracketing the actuation plane, the plates having mounted thereon electromagnets having a first polarity opposing electromagnets mounted on the plane having the opposite polarity, and for each point, a transit capable of reciprocating a push rod to displace the actuation plane at the respective point.

4. The apparatus of claim 2, wherein the means for displacing employs a principle selected from the group of electromagnetic, electromechanical, mechanical, hydraulic, and pneumatic.

5. The apparatus of claim 1, wherein the actuation mechanism is selected from the group consisting of:

two plates bracketing the actuation plane, the plates having mounted thereon electromagnets opposing electromagnets mounted on the actuation plane, the electromagnets on the plates having opposite polarity to the electromagnets on the actuation plane, and for each point, a transit capable of reciprocating a push rod to displace the actuation plane at the respective point.

6. The apparatus of claim 1, wherein the actuation mechanism employs a principle selected from the group of electromagnetic, electromechanical, mechanical, hydraulic, and pneumatic.

7. The apparatus of claim 1, wherein the linkage includes:

a rack operatively coupled to the actuation plane;

a rack guide guiding the rack; and a pinion gear operatively coupled to the rack and the fin.

8. The apparatus of claim 1, wherein the vehicle comprises a fuselage, each fin includes a hinge pin extending through the fuselage, each hinge pin includes a bore therethrough, and the linkage includes:

a plurality of bearing pins extending from the actuation plane;

a boss affixed to the vehicle fuselage for each fin;

a plurality of forks, each fork extending through a respective boss and into the bore of a respective hinge pin;

a bearing between each bearing pin and a respective one of the plurality of forks; and means for preventing free rotation of the actuation plane.

9. The apparatus of claim 8, wherein the means for preventing free rotation further includes:

a guide affixed to the vehicle fuselage, the guide having a track therein; and a guide pin extending from the actuation pin into the track.

10. The apparatus of claim 9, wherein the guide pin comprises one of the bearing pins.

11. The apparatus of claim 1, wherein the actuation mechanism displaces the actuation plane at three points simultaneously.

12. The apparatus of claim 1, wherein the actuation plane is a ring.

13. The apparatus of claim 1, wherein the linkage is operatively coupled to a thrust vector control system.

14. An apparatus for controlling the roll, pitch, and yaw attitudes of an air or sea vehicle, the apparatus comprising:

an actuator, including:

an actuation plane; and means for displacing the actuation plane at three points;

at least three non-propulsive fins; and means for linking the actuation plane and each one of the fins, the means for linking communicating the actuation plane's displacement to the respective one of the fins.

15. The apparatus of claim 14, wherein the means for displacing is selected from the group consisting of:

two plates bracketing the actuation plane, the plates having mounted thereon electromagnets opposing electromagnets mounted on the actuation plane, the electromagnets on the plates having opposite polarity to the electromagnets on the actuation plane, and for each point, a transit capable of reciprocating a push rod to displace the actuation plane at the respective point.

16. The apparatus of claim 14, wherein the means for displacing employs a principle selected from the group consisting of electromagnetic, electromechanical, mechanical, hydraulic, and pneumatic.

17. The apparatus of claim 14, wherein the means for linking includes:

a rack operatively coupled to the actuation plane;

a rack guide guiding the rack; and a pinion gear operatively coupled to the rack and the fin.

18. The apparatus of claim 14, wherein the vehicle comprises a fuselage, each fin includes a hinge pin extending through the fuselage, each hinge pin includes a bore therethrough, and the means for linking includes:

a plurality of bearing pins extending from the actuation plane;

a boss affixed to the vehicle fuselage for each fin;

a plurality of forks, each fork extending through a respective boss and into the bore of a respective hinge pin;

a bearing between each bearing pin and a respective one of the plurality of forks; and means for preventing free rotation of the actuation plane.

19. The apparatus of claim 18, wherein the means for preventing free rotation further includes:

a guide affixed to the vehicle fuselage, the guide having a track therein; and a guide pin extending from the actuation pin into the track.

20. The apparatus of claim 19, wherein the guide pin comprises one of the bearing pins.

21. The apparatus of claim 14, wherein the means for displacing displaces the actuation plane at three points simultaneously.

22. The apparatus of claim 14, wherein the actuation plane is a ring.

23. The apparatus of claim 14, wherein the means for linking is operatively coupled to a thrust vector control system.

24. A method for controlling the flight surfaces of an air or sea vehicle the method comprising actuating at least three fins using a plane to affect pitch, yaw, and roll.

25. The method of claim 24, wherein actuating the fins using a plane includes:

linking at least three flight surfaces to an actuation plane; and displacing the actuation plane at three points to control the flight surfaces.

26. The method of claim 25, wherein displacing the actuation plane includes displacing the actuation plane at the three different points simultaneously.

27. A method for controlling the flight surfaces of an air or sea vehicle, the method comprising:

linking at least three non-propulsive flight surfaces to an actuation plane; and displacing the actuation plane at three different points to control the flight surfaces.

28. The method of claim 27, wherein displacing the actuation plane at three different points includes displacing the actuation plane at the three different points simultaneously.

29. A fin actuation system for a missile including a missile fuselage, a blast tube, and at least three fins spaced around the fuselage and adapted to rotate relative to the fuselage, said systems comprising:

a planar member positioned in an annulus defined by the fuselage and the blast tube;

at least three actuation mechanisms operable to displace the planar member the longitudinal axis of the missile;

at least three linkages connecting each fin with a portion of the planar member and operable in response to displacement of the planar member to rotate the fin relative to the fuselage.

30. The fin actuation system of claim 29, wherein the at least three actuation mechanisms are selected from the group of:

two plates bracketing the planar member, the plates having mounted thereon electromagnets opposing electromagnets mounted on the planar member, the electromagnets on the plates having opposite polarity to the electromagnets on the planar member, and for each point, a transit capable of reciprocating a push rod to displace the planar member at the respective point.

31. The fin actuation system of claim 29, wherein the at least three linkages include:

a rack operatively coupled to the planar member;

a rack guide guiding the rack; and a pinion gear operatively coupled to the rack and the fin.

32. The apparatus of claim 29, wherein the vehicle comprises a fuselage, each fin includes a hinge pin extending through the fuselage, each hinge pin includes a bore therethrough, and the at least three linkages include:

a plurality of bearing pins extending from the actuation plane;

a boss affixed to the vehicle fuselage for each fin;

a plurality of forks, each fork extending through a respective boss and into the bore of a respective hinge pin;

a bearing between each bearing pin and a respective one of the plurality of forks; and means for preventing free rotation of the actuation plane.

33. The apparatus of claim 32, wherein the means for preventing free rotation further includes:

a guide affixed to the vehicle fuselage, the guide having a track therein; and a guide pin extending from the actuation pin into the track.

34. The apparatus of claim 33, wherein the guide pin comprises one of the bearing pins.

35. The fin actuation system of claim 29, wherein the at least three actuation mechanisms displace the planar member at three points simultaneously.

36. The fin actuation system of claim 29, wherein the planar member is a ring.

37. The fin actuation system of claim 29, wherein the linkage is operatively coupled to a thrust vector control system.

38. An air or sea vehicle, comprising:

a fuselage;

at least three non-propulsive fins; and a fin control system including:

an actuator, including:

an actuation plane; and an actuation mechanism, capable of displacing the actuation plane at three points;

at least three fins; and a linkage between the actuator and each one of the fins, the linkage communicating the actuation plane's displacement to the respective one of the fins.

39. The vehicle of claim 38, wherein the actuation mechanism comprises a means for displacing the actuation plane.

40. The vehicle of claim 38, wherein the actuation mechanism is selected from the group consisting of:

two plates bracketing the actuation plane, the plates having mounted thereon electromagnets opposing electromagnets mounted on the actuation plane, the electromagnets on the plates having opposite polarity to the electromagnets on the actuation plane, and for each point, a transit capable of reciprocating a push rod to displace the actuation plane at the respective point.

41. The vehicle of claim 38, wherein the linkage includes:

a rack operatively coupled to the actuation plane;

a rack guide guiding the rack; and a pinion gear operatively coupled to the rack and the fin.

42. The vehicle of claim 38, wherein the actuation mechanism displaces the actuation plane at three points simultaneously.

43. The vehicle of claim 38, wherein the actuation plane is a ring.

44. The vehicle of claim 38, wherein the linkage is operatively coupled to a thrust vector control system.

* * * * *